US010954929B2

(12) United States Patent
Costa

(10) Patent No.: US 10,954,929 B2
(45) Date of Patent: Mar. 23, 2021

(54) MATERIAL DISPENSING SYSTEM WITH GAS REMOVAL

(71) Applicant: Mueller International, LLC, Atlanta, GA (US)

(72) Inventor: Larry J. Costa, Mooresville, NC (US)

(73) Assignee: Mueller International, LLC, Atlanta, GA (US)

( * ) Notice: Subject to any disclaimer, the term of this patent is extended or adjusted under 35 U.S.C. 154(b) by 0 days.

(21) Appl. No.: 16/135,670

(22) Filed: Sep. 19, 2018

(65) Prior Publication Data

US 2020/0088177 A1 Mar. 19, 2020

(51) Int. Cl.
*F04B 13/02* (2006.01)
*B01F 15/04* (2006.01)
*B01F 15/02* (2006.01)

(52) U.S. Cl.
CPC ..... *F04B 13/02* (2013.01); *B01F 15/0458* (2013.01); *B01F 15/0462* (2013.01); *B01F 15/0218* (2013.01)

(58) Field of Classification Search
CPC ..... B01F 15/0237; B01F 15/0238; B01F 15/0227; B01F 15/0458; B01F 15/0462; B01F 15/0247; F04B 49/24; F04B 49/243; F04B 13/02
See application file for complete search history.

(56) References Cited

U.S. PATENT DOCUMENTS 2,557,841 A * 6/1951 Preusser ..... B01F 5/0268 366/137
2,684,805 A * 7/1954 McBean ..... B65B 31/003 141/3
2,724,581 A * 11/1955 Pahl ..... B67C 3/22 366/152.1
2,851,197 A * 9/1958 Colton ..... F23K 5/20 222/146.5
3,071,293 A * 1/1963 Lewis-Smith ..... B01F 7/0065 222/135

(Continued)

OTHER PUBLICATIONS

Exact Dispensing Systems: Data Sheet for Model 9450 Double Acting Dispensing System, published Oct. 10, 2016, 9 pgs.*

(Continued)

*Primary Examiner* — Paul R Durand
*Assistant Examiner* — Randall A Gruby
(74) *Attorney, Agent, or Firm* — Taylor English Duma LLP

(57) ABSTRACT

A material dispensing system can comprise a first and second supply container housing a first and second material, respectively, comprising a first and second fluid, respectively; a first and second metering cylinder fluidly connected to the first and second supply container, respectively, the second metering cylinder configured to move from a first to a second stroke position in unison with the first metering cylinder; a dispensing head configured to receive a first and second liquid of the first and second fluids, respectively; a first recycling valve positioned between the first metering cylinder and the dispensing head; and a second recycling valve positioned between the second metering cylinder and the dispensing head, the first and second recirculating valves configured to draw a portion of the first and second fluids back into the first and second supply containers, respectively, in an open position.

10 Claims, 18 Drawing Sheets

(56) References Cited

U.S. PATENT DOCUMENTS 3,072,462 A * 1/1963 Anderson ..... B05B 12/1418 422/131
3,115,282 A * 12/1963 McKenzie ..... F16N 27/00 222/318
3,166,020 A * 1/1965 Cook ..... B01F 5/0413 417/198
3,223,040 A * 12/1965 Dinkelkamp ..... G05D 11/132 417/3
3,851,801 A * 12/1974 Roth ..... B05B 9/01 222/146.5
3,982,663 A * 9/1976 Larkin ..... B05B 9/0406 222/1
4,049,244 A 9/1977 Hedrich
4,228,924 A * 10/1980 Gilbert ..... B01F 15/0237 137/99
4,279,360 A 7/1981 Hauser
4,307,760 A 12/1981 Hauser
4,317,647 A 3/1982 Hauser
4,390,035 A * 6/1983 Hill ..... A01M 7/0092 137/99
4,391,529 A 7/1983 Hedrich et al.
4,611,982 A 9/1986 Haeuser et al.
4,621,928 A * 11/1986 Schreiber ..... B01D 21/245 366/137
4,741,623 A 5/1988 Haeuser et al.
4,857,355 A * 8/1989 Gregg ..... B01F 5/106 426/590
5,147,660 A 9/1992 Steindorf
5,217,146 A 6/1993 Neff et al.
5,257,722 A 11/1993 Neff et al.
5,409,253 A 4/1995 Cheng
5,545,029 A 8/1996 Hauser
5,551,486 A 9/1996 Hauser et al.
5,591,252 A 1/1997 Haeuser
5,942,258 A 8/1999 Hauser
6,065,860 A * 5/2000 Fuchsbichler ..... B01F 1/0022 366/136
6,168,048 B1 * 1/2001 Xu ..... B67D 1/045 222/1
6,306,322 B1 10/2001 Hauser et al.
6,732,448 B2 5/2004 Strzala
8,092,073 B2 * 1/2012 Asplund ..... B01F 3/188 366/136
8,839,760 B1 9/2014 Hedrich
10,077,332 B2 * 9/2018 Jeol ..... C08G 59/184
2005/0284882 A1 * 12/2005 Belongia ..... G01F 11/284 222/64
2006/0209623 A1 * 9/2006 Duschanek ..... B29B 7/90 366/159.1
2015/0077947 A1 * 3/2015 Jordan, Jr. ..... H05K 3/284 361/748
2015/0184801 A1 * 7/2015 Gurney ..... F16K 15/183 222/318
2017/0369731 A1 * 12/2017 Lisitsin ..... B33Y 70/00
2018/0016464 A1 * 1/2018 Lisitsin ..... C08K 3/36

OTHER PUBLICATIONS

Duravalve, Inc.; Brochure for Duravalve Model DM 340 Ball Valve 3 Piece Full Port Stainless Steel, publicly available prior to Sep. 19, 2018, 2 pgs.
Duravalve, Inc.; Brochure for Duravalve Model DM 340 Ball Valve with DurAir II Pneumatic Actuator, publicly available prior to Sep. 19, 2018, 1 pg.
Duravalve, Inc.; Brochure for Duravalve Model DM 340 Ball Valve with Electric Actuator, publicly available prior to Sep. 19, 2018, 1 pg.
EFI Polymers; Data Sheet for Urethane System, published Jan. 14, 2013, 2 pgs.
Exact Dispensing Systems; Article entitled: "Q&A on Meter/Mix Equipment", located at <https://mailchi.mp/exactdispensing/potting-solutionssave-the-datecryogenically-tempered-2527365>, accessed on Sep. 19, 2018 and publicly available prior to Sep. 19, 2018, 4 pgs.
Exact Dispensing Systems; Article entitled: Industrial Servo Motor Stator Encapsulation, located at <www.exactdispensing.com, publicly available prior to Sep. 19, 2018, 1 pg.
Exact Dispensing Systems; Data Sheet for Model 9450 Double Acting Dispensing System, published Oct. 10, 2016, 3 pgs.
Exact Dispensing Systems; Drawing for 9450 Base System w/ Optional Auto Replenishment, published Jul. 19, 2012, 1 pg.
Genius Devils; Article entitled: "Inductive Proximity Sensors", located at <http://geniusdevils.com/2013/04/inductive-proximity-sensors/>, accessed on Jun. 18, 2018, 4 pgs.
Exact Dispensing Systems; Manual for Model 9450 Double Acting Meter/Mix & Dispense System, dated Jul. 8, 2013, 37 pgs.
Yamada Pumps; Brochure for High Pressure Pump, publicly available prior to Sep. 19, 2018, 7 pgs.

* cited by examiner

MATERIAL DISPENSING SYSTEM WITH GAS REMOVAL

TECHNICAL FIELD

Field of Use

This disclosure relates to systems for dispensing fluids in a manufacturing environment. More specifically, this disclosure relates to systems for accurately dispensing multi-component potting materials or casting resins.

Related Art

A material dispensing system can be used in the manufacturing and sealing of electrical components, the fabrication of lightweight resin-impregnated composite structures, and in other components and processes. It can be advantageous to mix different materials immediately before using the different materials to achieve desirable properties in a dispensed mixture. Some materials must be mixed at precise ratios in order to form the desired properties in the dispensed mixture.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a material dispensing system comprising a first supply container housing a first material, the first material comprising a first fluid; a second supply container housing a second material, the second material comprising a second fluid; a first metering cylinder fluidly connected to the first supply container; a second metering cylinder fluidly connected to the second supply container, the second metering cylinder connected to the first metering cylinder, the second metering cylinder configured to move from a first stroke position to a second stroke position in unison with the first metering cylinder; a dispensing head configured to receive a first liquid of the first fluid and a second liquid of the second fluid; a first recycling valve positioned between the first metering cylinder and the dispensing head, the first recycling valve configured to draw a portion of the first fluid back into the first supply container in an open position of the first recycling valve; and a second recycling valve positioned between the second metering cylinder and the dispensing head, the second recycling valve configured to draw a portion of the second fluid back into the second supply container in an open position of the second recycling valve.

In a further aspect, disclosed is a method of dispensing a mixture of two fluids, the method comprising drawing a first fluid from a first supply source, the first fluid comprising a first liquid; drawing a second fluid from a second supply source, the second fluid comprising a second liquid; moving a first metering cylinder and a second metering cylinder in unison from a first stroke position to a second stroke position, the first metering cylinder fluidly connected to the first supply source and the second metering cylinder fluidly connected to the second supply source; simultaneously dispensing each of the first fluid and the second fluid from a dispensing head fluidly connected to the first metering cylinder with a first fluid dispensing connection and to the second metering cylinder with a second fluid dispensing connection; automatically closing the dispensing head to stop dispensing of each of the first fluid and the second fluid based on a position of each of the first metering cylinder and the second metering cylinder; drawing a portion of the first fluid back into the first supply source; and drawing a portion of the second fluid back into the second supply source.

In yet a further aspect, disclosed is a method of dispensing a material, the method comprising: drawing the material from a supply source, the material comprising a liquid; moving a metering cylinder from a first stroke position to a second stroke position, the metering cylinder fluidly connected to the supply source; dispensing the fluid from a dispensing head fluidly connected to the metering cylinder; automatically closing the dispensing head to stop dispensing of the fluid based on a position of the metering cylinder; and drawing a portion of the material back into the supply source.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
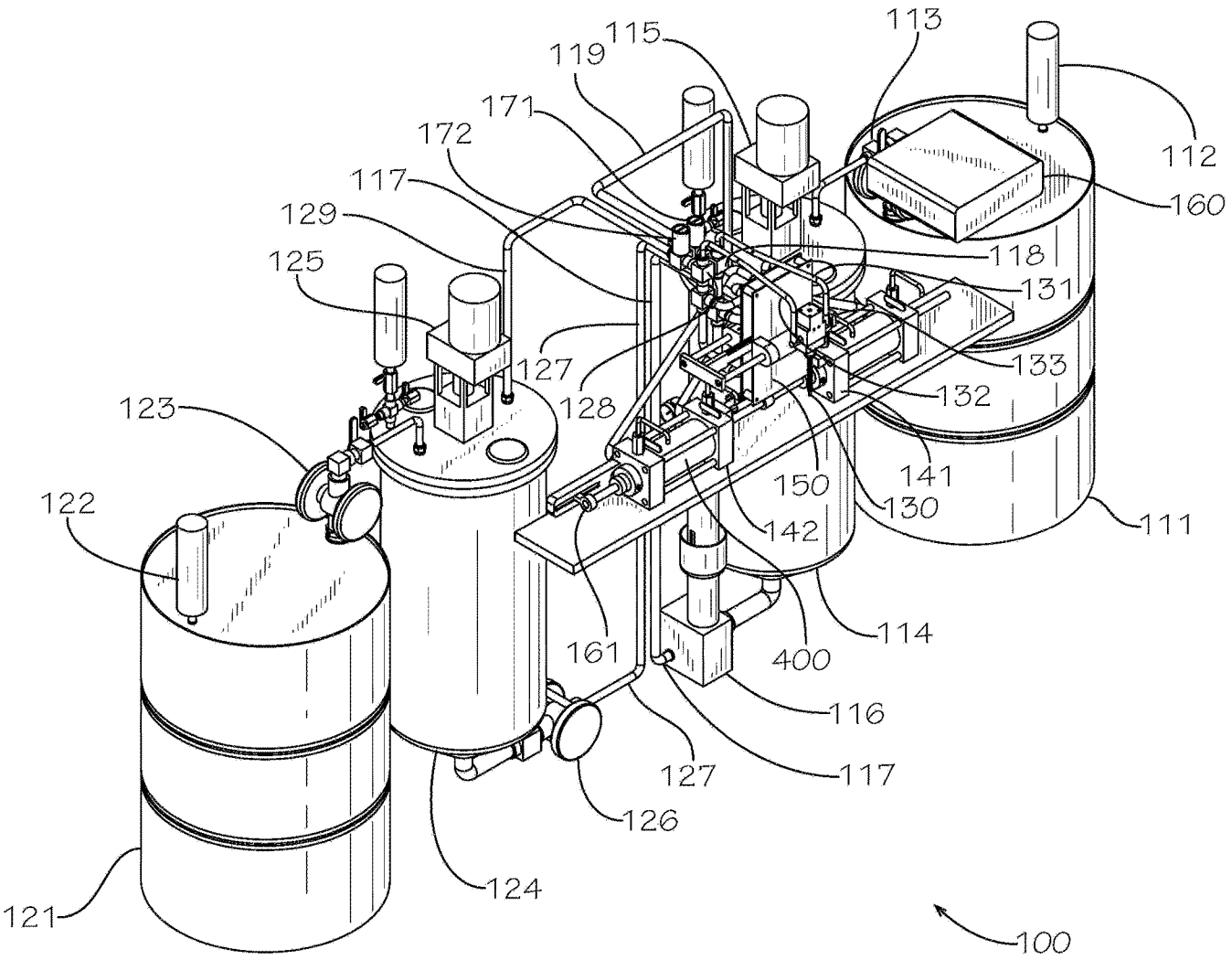
FIG. 1 is a left front top perspective view of a two-part potting material dispensing system in a dispensing condition in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

As disclosed herein, any "connection" can include a mechanical connection.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of the system nearest to and occupied by a user of the system standing in front of and facing the dispensing head during its intended use; "rear" is that end of the system that is opposite or distal the front; "left" is that which is to the left of or facing left from the same user while in the same position and orientation; and "right" is that which is to the right of or facing right from that same person while in the same position and orientation. "Horizontal" or "horizontal orientation" describes that which is in a plane extending from left to right and aligned with the horizon. "Vertical" or "vertical orientation" describes that which is in a plane that is angled at 90 degrees to the horizontal.

In one aspect, a multi-component material dispensing system and associated methods, systems, devices, and various apparatuses are disclosed herein. In one aspect, the multi-component material dispensing system can comprise recycling valves.

As shown in FIG. 1, a material dispensing system 100 can comprise a first supply or supply source, which can comprise a first supply container 111, and a second supply or supply source, which can comprise a second supply container 121. The first supply container 111 and the second supply container 121 can be configured to store and incrementally supply a first material 81 (shown in FIG. 11) and a second material 82 (shown in FIG. 11), respectively. The first material 81 and the second material 82 can comprise a first fluid and a second fluid, respectfully, such that each of the first material 81 and the second material 82 can flow through the system 100 towards a dispensing head 133, which can comprise a dispensing valve. The first material 81 and the second material 82—and therefore also the first fluid and the second fluid—can comprise a first liquid and a second liquid, respectfully.

As a fluid, each of the first material 81 and the second material 82 can comprise both liquid and gaseous portions. Such liquid and gaseous portions need not be different phases of the same substance. For example and without limitation, in some aspects, the liquid portions of the first material 81 and the second material 82 can be an epoxy resin and an epoxy hardener, respectively, while the gaseous portions of the first material 81 and the second material 82 can be or can at least comprise a gas such as nitrogen. In other aspects, a two-component mixture 83 (shown in FIG. 11)—and, in other aspects, the multi-component mixture—dispensed by the system can comprise any other desired mixture including, for example and without limitation, an adhesive, a urethane material, a silicone material, or a polysulfide, and the mixture can be blended with "fillers" such as, for example and without limitation, plastic, aggregate, or sand. In other aspects, the gaseous portions of the first material 81 and the second material 82 can comprise air or any other gas. In other aspects, small amounts of moisture can be trapped in either the first material 81 or the second material 82. Any such moisture can subsequently be "boiled off" during, for example and without limitation, vacuum degassing of the material as described below. In some aspects, portions of the system 100 used for distributing and metering the second material 82 can be removed or isolated and the system 100 can be used to dispense and degas a single material such as the material 81.

The system 100 can comprise a drier 112, which can be attached and fluidly connected to the first supply container 111. Likewise, the system 100 can comprise a drier 122, which can be attached and fluidly connected to the second supply container 121. In some aspects, either of the driers 112, 122 can be a desiccant air vent drier. Each of the driers 112, 122 can facilitate the removal of moisture from the first supply container 111 and the second supply container 121, respectively, by drawing moisture into itself to be absorbed into a moisture-wicking desiccant material. In other aspects, another type of drier or drying agent can be used.

The system 100 can comprise a first transfer pump 113, which can be attached and fluidly connected to the first supply container 111. Likewise, the system 100 can comprise a second transfer pump 123, which can be attached and fluidly connected to the second supply container 121. In some aspects, either of the first transfer pump 113 or the second transfer pump 123 can be a liquid pneumatic pump. In other aspects, either of the first transfer pump 113 or the second transfer pump 123 can be another type of pump.

The system 100 can comprise a first preparation tank 114 and a second preparation tank 124. The first preparation tank 114 and the second preparation tank 124 can be fluidly connected to the first supply container 111 and the second supply container 121, respectively. Passage of the first material 81 and the second material 82 from the first supply container 121 to the first preparation tank 114 and from the second supply container 121 to the second preparation tank 124, respectively, can be regulated with a first loading valve 2131 (shown in FIG. 2) and a second loading valve 2231 (also shown in FIG. 2), respectively.

The system 100 can comprise a first agitator 115, which can be secured to the first preparation tank 114, and a second agitator 125, which can be secured to the second preparation tank 124. In some aspects, either of the first agitator 115 and the second agitator 125 can be a mixing agitator. In other aspects, either of the first agitator 115 and the second agitator 125 can be another type of agitator. Each of the first agitator 115 and the second agitator 125 can facilitate even mixing of the first material 81 inside the first preparation tank 114 and the second material 82 inside the second preparation tank 124, respectively.

The system 100 can comprise a first delivery pump 116, which can be fluidly connected to the first preparation tank 114, and a second delivery pump 126, which can be fluidly connected to the second preparation tank 124. In some aspects, either of the first delivery pump 116 and the second delivery pump 126 can be a diaphragm pump. In other aspects, either of the first delivery pump 116 and the second delivery pump 126 can be another kind of pump. As shown, the first delivery pump 116 can be a diaphragm pump and the second delivery pump 126 can be a reciprocating pneumatic motor fluid pump such as, for example and without limitation, either of those described in U.S. Pat. Nos. 5,586,480 and 5,647,737.

The system 100 can comprise a first delivery pipe 117, which can be fluidly connected to the first delivery pump 116, and a second delivery pipe 127, which can be fluidly connected to the second delivery pump 126. The first delivery pipe 117 and the second delivery pipe 127 can transport the first material 81 and the second material 82, respectively, to the metering cylinder assembly 400, to which each of the first delivery pipe 117 and the second delivery pipe 127 can be fluidly connected.

As shown, the metering cylinder assembly 400 can comprise a first metering cylinder 141, which can be fluidly connected to the first supply container 111, and a second metering cylinder 142, which can be fluidly connected to the second supply container 121. The second metering cylinder 142 can be connected to the first metering cylinder 141. The metering cylinder assembly 400 can comprise a shuttle-valve assembly 150, which can operate—simultaneously as desired—various valves of the metering cylinder assembly 400 to transport the first material 81 and the second material 81 as desired, as will be described below. A control system 160 can be operatively connected to and in electrical or electronic communication with and control components of the system 100 such as, for example and without limitation, the pumps 113, 123, 116, 126 and the dispensing head 133 and can receive inputs from components of the system such as, for example and without limitation, an encoder 161 or other component functioning as a position sensor or a foot pedal (not shown), which can cause the control system 160 to open or close the dispensing head 133 to start or stop dispensing the mixture 83 (shown in FIG. 11) of the materials 81, 82. The control system 160 can effectively control the operation of various other aspects of the system 100 including components such as, for example and without limitation, a first recycling valve 171 and a second recycling valve 172. As an input to a controller such as the control system 160, the encoder 161, which be a linear position encoder, can signal movement or a position of a rod 410 (shown in FIG. 4) of the metering cylinder assembly 400 and thereby signal a stroke position of each of the first metering cylinder 141 and the second metering cylinder 142.

The system 100 can comprise a first return pipe 119 and a second return pipe 129. The first return pipe 119 can fluidly connect the metering cylinder assembly 400 to the first preparation tank 114 via a first exit tee 118, and the second return pipe 129 can fluidly connect the metering cylinder assembly 400 to the second preparation tank 124 via a second exit tee 128. The first recycling valve 171 can regulate flow of the first material 81 from the metering cylinder assembly 400 to the first preparation tank 114, and the second recycling valve 172 can regulate flow of the second material 82 from the metering cylinder assembly 400 to the second preparation tank 124. As shown in FIG. 1, each of the recycling valve 171 and the recycling valve 172 can be maintained in a closed position in which movement of the first material 81 into the first return pipe 119 and movement of the second material 82 into the second return pipe 129, respectively, is blocked. As shown, each portion of the first material 81 and the second material 82 that is recycled can be returned to the respective preparation tanks 114, 124 proximate to a topmost level of the respective material 81, 82 inside the respective preparation tanks 114, 124, a level or position within the preparation tank 114, 124 which can be the farthest away from the bottom outlet of the preparation tank 114, 124 through which the material 81, 82 can be fed into the delivery pump 116, 126. Any material 81, 82 that is recycled can be separated into liquid and gaseous portions as it is dispersed or vented back onto the top of the material 81, 82 in the preparation tank 114, 124 before being subsequently dispensed.

The dispensing head 133 can comprise the dispensing valve and a dispensing nozzle 130, which can be a dispensing mixing nozzle. A first feeder pipe 131 and a second feeder pipe 132 can transport the first material 81 and the second material 82, respectively, from the metering cylinder assembly 400 to the dispensing head 133 via the first exit tee 118 and the second exit tee 128, respectively.

Figure 2:
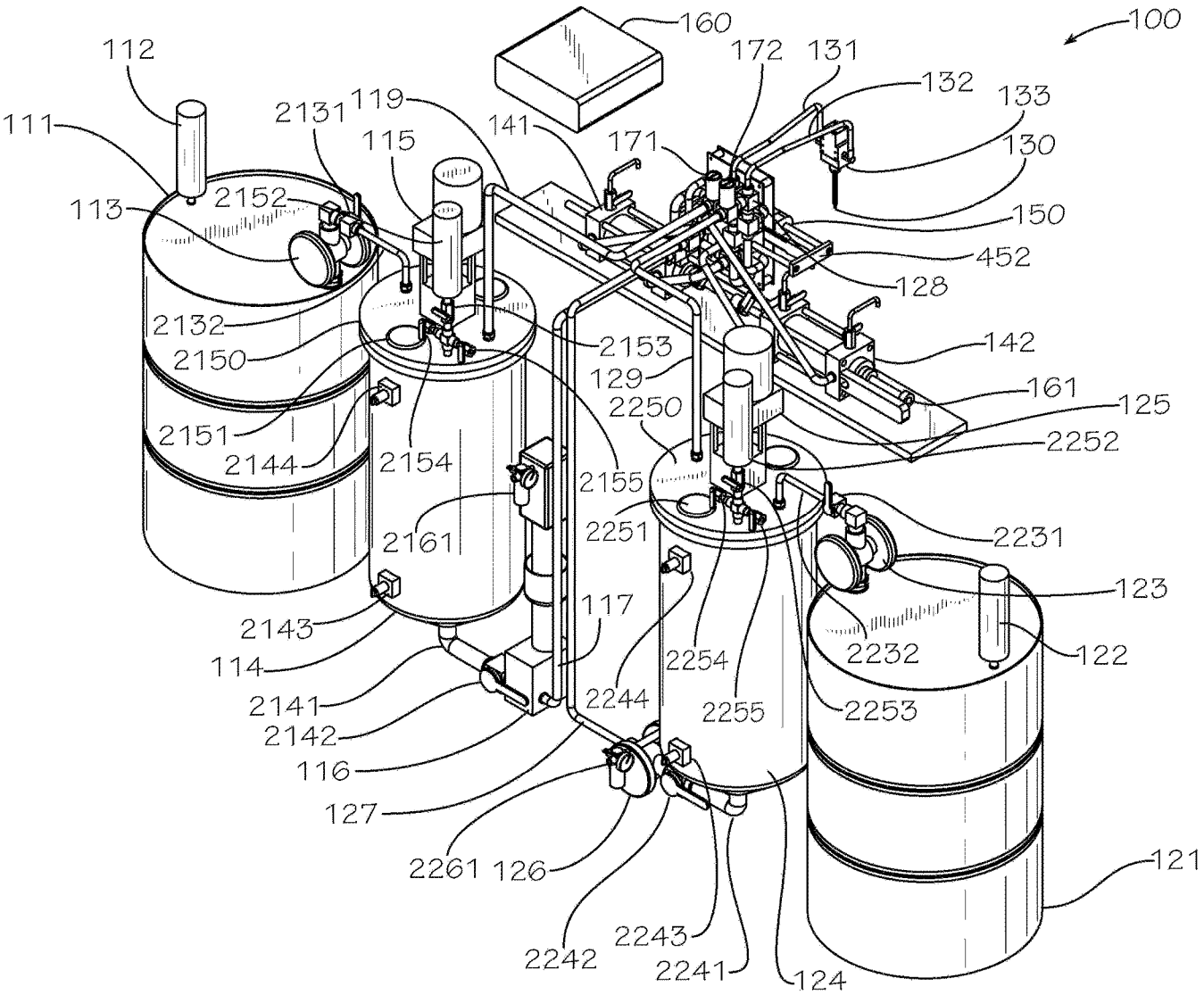
FIG. 2 is a left rear top perspective view of the system of FIG. 1 in a recycling condition, wherein each of a pair of recycling valves of the system is open.

As shown in FIG. 2, a first loading pipe 2132 can fluidly connect the first supply container 111 to the first preparation tank 114 and thereby transport the first material 81 between the first supply container 111 and the first preparation tank 114, the flow of which can again be regulated by the first loading valve 2131. Likewise, a second loading pipe 2232 can fluidly connect the second supply container 121 to the second preparation tank 124 and thereby transport the second material 82 between the second supply container 121 and the second preparation tank 124, the flow of which can again be regulated by the second loading valve 2231.

The first preparation tank 114 can comprise a first top end 2150, a first inspection port 2151, a drier 2152, a first drier valve 2153, a first extraction valve 2154, and a first blanket valve 2155. Similarly, the second preparation tank 124 can comprise a second top end 2250, a second inspection port 2251, a drier 2252, a second drier valve 2253, a second extraction valve 2254, and a second blanket valve 2255.

The first inspection port 2151 and the second inspection port 2251 can be mounted in or secured to the first top end 2150 and the second top end 2250, respectively. Either of the first inspection port 2151 and the second inspection port 2251 can comprise a glass or other transparent material to facilitate viewing of the first material 81 and the second material 82 inside the first preparation tank 114 and the second preparation tank 124, respectively.

The first drier 2152 and the second drier 2252 can be fluidly connected to the first preparation tank 114 and the second preparation tank 124, respectively, and the respective drier valves 2153, 2253 can regulate flow of fluid and/or moisture between each respective drier 2152, 2252 and the respective preparation tanks 114, 124. Each of the driers 2152, 2252 can facilitate the removal of moisture from the first preparation tank 114 and the second preparation tank 124, respectively, by drawing moisture into itself to be absorbed into a moisture-wicking desiccant material. In other aspects, another type of drier can be used.

Either of the first extraction valve 2154 and the second extraction valve 2254 can be a liquid tank vacuum degassing extraction valve and can facilitate the removal of gas from the first preparation tank 114 and the second preparation tank 124, respectively. In other aspects, either of the first extraction valve 2154 and the second extraction valve 2254 can have a different use.

Either of the first blanket valve 2155 and the second blanket valve 2255 can be an inert gas blanket valve and can facilitate the introduction of an inert gas such as nitrogen into a top of the first preparation tank 114 and the second preparation tank 124, respectively, including when the respective material 81, 82 is pulled from the respective preparation tank 114, 124, thereby increase the amount of free volume inside the respective preparation tank 114, 124 with which the inert gas can be introduced.

The first preparation tank 114 and the second preparation tank 124, respectively, can comprise a low level sensor 2143, 2243, respectively, and a high level sensor 2144, 2244, respectively. Each of the low level sensors 2143, 2243 and the high level sensors 2144, 2244 can facilitate monitoring of the level of the respective material 81, 82 inside the respective preparation tank 114, 124 and, as needed, refilling of the first preparation tank 114 and the second preparation tank 124 from the first supply container 111 and the second supply container 121 by operation of the first transfer pump 113 and the second transfer pump 123, respectively.

The first preparation tank 114 and the second preparation tank 124, respectively, can comprise a first bottom transfer pipe 2141 and a second bottom transfer pipe 2241, respectively. The first preparation tank 114 and the second preparation tank 124, respectively, can comprise a first bottom transfer valve 2142 and a second bottom transfer valve 2242. The first bottom transfer valve 2142 and the second bottom transfer valve 2242 can regulate flow of the respective material 81, 82 through the first bottom transfer pipe 2141 and the second bottom transfer pipe 2241 from the first preparation tank 114 and the second preparation tank 124, respectively, to the first delivery pump 116 and the second delivery pump 126, respectively. At either of the first delivery pump 116 and the second delivery pump 126, respectively, a first pressure regulator 2161 and a second pressure regulator 2261, respectively, can facilitate maintenance of a desired pressure on either side of the respective delivery pump 116, 126. As shown, the first pressure regulator 2161 and the second pressure regulator 2261, respectively, can facilitate maintenance of a desired pressure on the side of the respective delivery pump 116, 126 nearest the dispensing nozzle 130 to help ensure a desired supply of the respective material 81, 82 to the metering cylinder assembly 400 and ultimately the dispensing nozzle 130.

As shown in FIG. 2, each of the recycling valve 171 and the recycling valve 172 can be maintained in an open position in which movement of the first material 81 into the first return pipe 119 and movement of the second material 82 into the second return pipe 129, respectively, is allowed.

Figure 3:
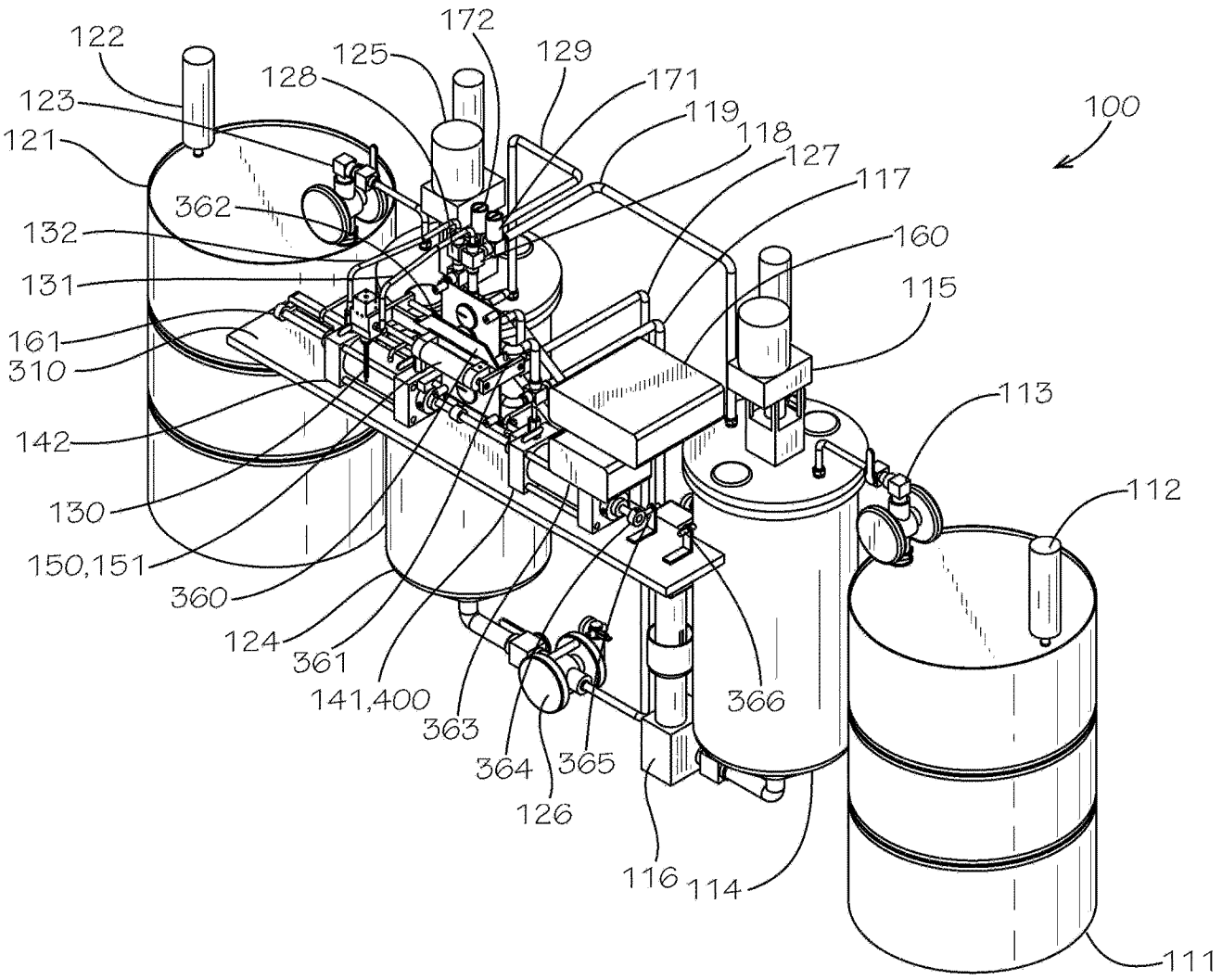
FIG. 3 is a right front top perspective view of the system of FIG. 1 in the recycling condition, the system further comprising an auxiliary recycling controller in accordance with another aspect of the current disclosure.

As shown in FIG. 3, the system 100 can further comprise a recycling controller 363. In some aspects, as shown, the recycling controller 363 can be physically and electronically separate from the control system 160. In such aspects, the recycling controller 363 can operate completely independent from the control system 160. In other aspects, the recycling controller 363—or at least the features and functions of the recycling controller 363—can be tied or incorporated into the control system 160.

The shuttle-valve assembly 150 of the metering cylinder assembly 400 can comprise a sensor mount 360. Each of a first shuttle cylinder position sensor 361, which can be a right shuttle cylinder position sensor, and a second shuttle cylinder position sensor 362 (shown in FIG. 4), which can be a left shuttle cylinder position sensor, can be mounted on the shuttle cylinder sensor mount 360. Each of the first shuttle cylinder position sensor 361 and the second shuttle cylinder position sensor 362 can sense when shuttle cylinders 151, 152 (152 shown in FIG. 4) of the shuttle-valve assembly 150 have reached a desirable cylinder travel position, which can be proximate to an end-of-travel position at either end of either of the shuttle cylinders 151, 152. In some aspects, sensing of the positions of the shuttle cylinders 151, 152 by the shuttle cylinder position sensors 361, 362 can serve as a proxy for sensing of the position of the metering cylinders 141, 142 by a separate sensor. The shuttle cylinder position sensors 361, 362, for example, can even replace the function of the metering cylinder position sensors 365, 366 described below.

The system 100 can further comprise a mounting bed 310, to which the metering cylinder assembly 400 can be secured. The system 100 can comprise the metering cylinder position sensors 365, 366, which can be secured to the mounting bed 310. In some aspects, the system 100 can comprise a single metering cylinder position sensor 365, 366. In other aspects, the system 100 can comprise a pair of metering cylinder position sensors 365, 366. In other aspects, the system 100 can comprise more than two metering cylinder position sensors 365, 366. In any case, a position sensor such as the metering cylinder position sensor 365, 366 can sense the position of the rod 410 of the metering cylinder assembly 400. In some aspects, a position flag 364 can be secured to or mounted around the rod 410, in which case the position flag 364 can be a portion of the rod 410 whose movement is sensed by either or both of the metering cylinder position sensors 365, 366. The position flag 364, the metering cylinder position sensor 365, and the metering cylinder position sensor 366 can be positioned relative to one another such that the first metering cylinder position sensor 365 and the second metering cylinder position sensor 366 can effectively sense "near" end of travel of the rod 410, which can be the point at which the rod 410 nears the end of travel and, as will be described, gas that can be trapped inside the first material 81 and the second material 82 can be introduced into the respective first transfer pipes 411, 412 or the second transfer pipes 412, 422.

Figure 4:
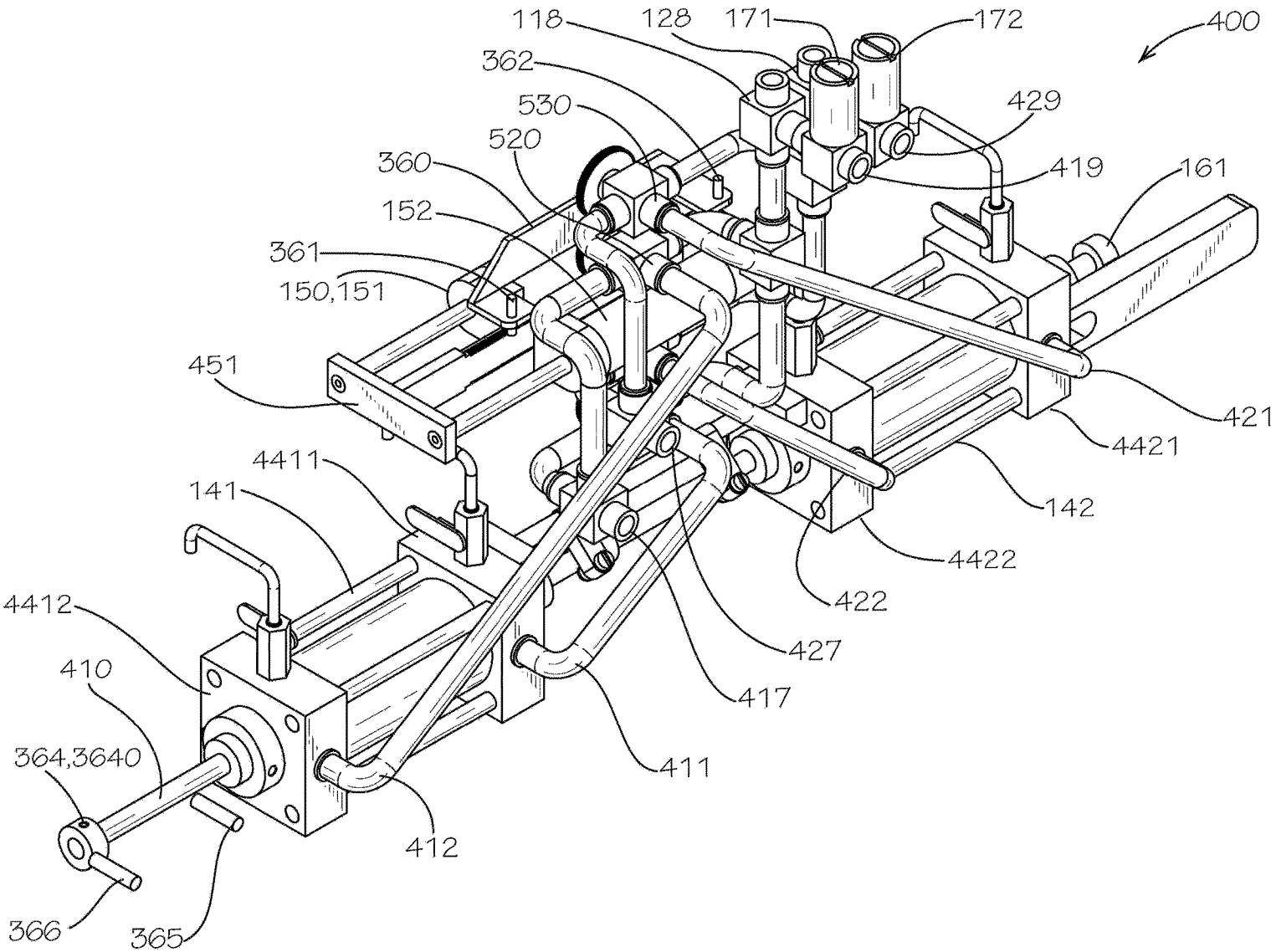
FIG. 4 is a right rear top perspective view of a metering cylinder assembly of the system of FIG. 3 in the recycling condition.

As shown in FIG. 4, the metering cylinder assembly 400 can comprise the first exit tee 118 and the second exit tee 128, to which the first recycling valve 171 and the second recycling valve 172, respectively, can be fluidly connected. The first metering cylinder 141 can comprise a first end 4411 and a second end 4412. Likewise, the second metering cylinder 142 can comprise a first end 4421 and a second end 4422. Any of the first end 4411, 4421 and the second end 4412, 4422 can comprise an end stop or an end cap.

The metering cylinder assembly 400 can comprise a first transfer pipe 411 fluidly connecting the first end 4411 of the first metering cylinder 141 to a lower valve 521 (shown in FIG. 5); and the metering cylinder assembly 400 can comprise a second transfer pipe 412 fluidly connecting the second end 4412 of the first metering cylinder 141 to an upper valve 520. The metering cylinder assembly 400 can comprise a first transfer pipe 421 fluidly connecting the first end 4421 of the second metering cylinder 142 to an upper valve 530; and the metering cylinder assembly 400 can comprise a second transfer pipe 422 fluidly connecting the second end 4422 of the second metering cylinder 142 to a lower valve 531 (shown in FIG. 5). Each of the transfer pipes 411, 412 and the transfer pipes 412, 422 can be used for both inflow and outflow of the respective materials 81, 82, depending on whether the rod 410 of the metering cylinder assembly is moving in a first axial direction or a second axial direction opposite the first axial direction.

As shown, the side of the metering cylinder assembly 400 handling the first material 81 can comprise a first inlet port 417, which can receive the first delivery pipe 117, and a first return port 419, which can receive the first return pipe 119. Likewise, the side of the metering cylinder assembly 400 handling the second material 82 can comprise a second inlet port 427, which can receive the second delivery pipe 127, and a second return port 429, which can receive the second return pipe 129. As described above, the delivery pipes 117, 127 can be used to transport the materials 81, 82 from the preparation tanks 114, 124, respectively.

The metering cylinder position sensors 365, 366, shown in FIG. 4 without the mounting brackets for clarity, can be oriented facing the rod 410 and substantially perpendicular to the rod 410. The position flag 364 can be secured to the rod 410 with a fastener 3640, which can be, for example and without limitation, a set screw or a pin. As shown, the shuttle cylinder position sensors 361, 362 can sense the position of a portion of the shuttle-valve assembly 150 such as a first bar 451 on a first end of a moving portion of the shuttle-valve assembly 150 and a second bar 452 (shown in FIG. 2) on a second end of a moving portion of the shuttle-valve assembly 150. Again, the sensor mount 360 can be used to support and maintain the position of the shuttle cylinder position sensors 361, 362.

Figure 5:
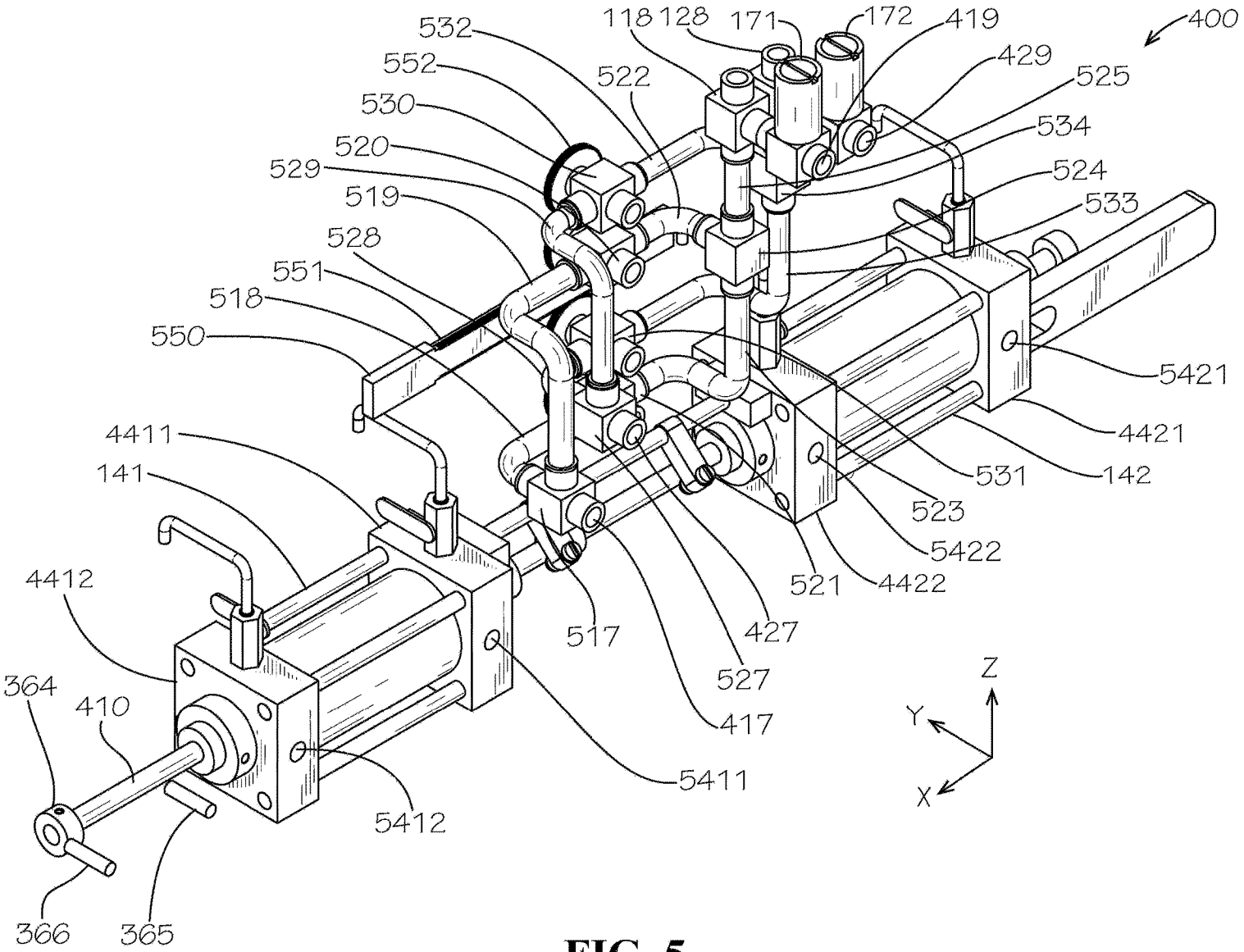
FIG. 5 is a right rear top perspective view of the metering cylinder assembly of FIG. 4 with transfer pipes of the metering cylinder assembly and actuators of a valve rack of the meter cylinder assembly removed for clarity.

As shown in FIG. 5, which shows portions of the shuttle-valve assembly 150 (e.g., the sensor mount 360 and the shuttle cylinder position sensors 361, 362) as well as the first transfer pipes 411, 421 and the second transfer pipes 412, 422 removed for clarity, the shuttle-valve assembly 150 can comprise an actuator rack 550 defining teeth 551. In some aspects, as shown, each of the actuator rack 550, the shuttle cylinders 151, 152, and the metering cylinders 141, 142 can be oriented along and be configured to move along an X-axis direction as shown. In other aspects, movement can be along an Y-axis direction or a Z-axis direction or at an angle to any of the X-axis direction, the Y-axis direction, and the Z-axis direction.

Again, the metering cylinder assembly 400 can comprise the first inlet port 417, the second inlet port 427, the first return port 419, and the second return port 429. The first inlet port 417 can be defined in a first inlet tee 517, while the second inlet port 427 can be defined in a second inlet tee 527. A transfer pipe 518 can fluidly connect the first inlet tee 517 to the lower valve 521, and a transfer pipe 528 can fluidly connect the second inlet tee 527 to the lower valve 531. Similarly, a transfer pipe 519 can fluidly connect the first inlet tee 517 to the upper valve 520, and a transfer pipe 529 can fluidly connect the second inlet tee 527 to the upper valve 530.

The metering cylinder assembly 400 can comprise a first outlet tee 524 and a second outlet tee 534. A transfer pipe 522 can fluidly connect the first outlet tee 524 to the upper valve 520, and a transfer pipe 532 can fluidly connect the second outlet tee 534 to the upper valve 530. A transfer pipe 523 can fluidly connect the first outlet tee 524 to the lower valve 521, and a transfer pipe 533 can fluidly connect the second outlet tee 534 to the lower valve 531. A transfer pipe 525 can fluidly connect the first outlet tee 524 to the first exit tee 118, and a transfer pipe (not shown) can fluidly connect the second outlet tee 534 to the second exit tee 128.

The first metering cylinder 141 can define a first transfer port 5411 at the first end 4411 and a second transfer port 5412 at the second end 4412, which can be sized and otherwise configured to receive the first transfer pipe 411 (shown in FIG. 4) and the second transfer pipe 412 (shown in FIG. 4), respectively. Likewise, the second metering cylinder 142 can define a first transfer port 5421 at the first end 4421 and a second transfer port 5422 at the second end 4422, which can be sized and otherwise configured to receive the first transfer pipe 421 (shown in FIG. 4) and the second transfer pipe 422 (shown in FIG. 4), respectively.

Figure 6:
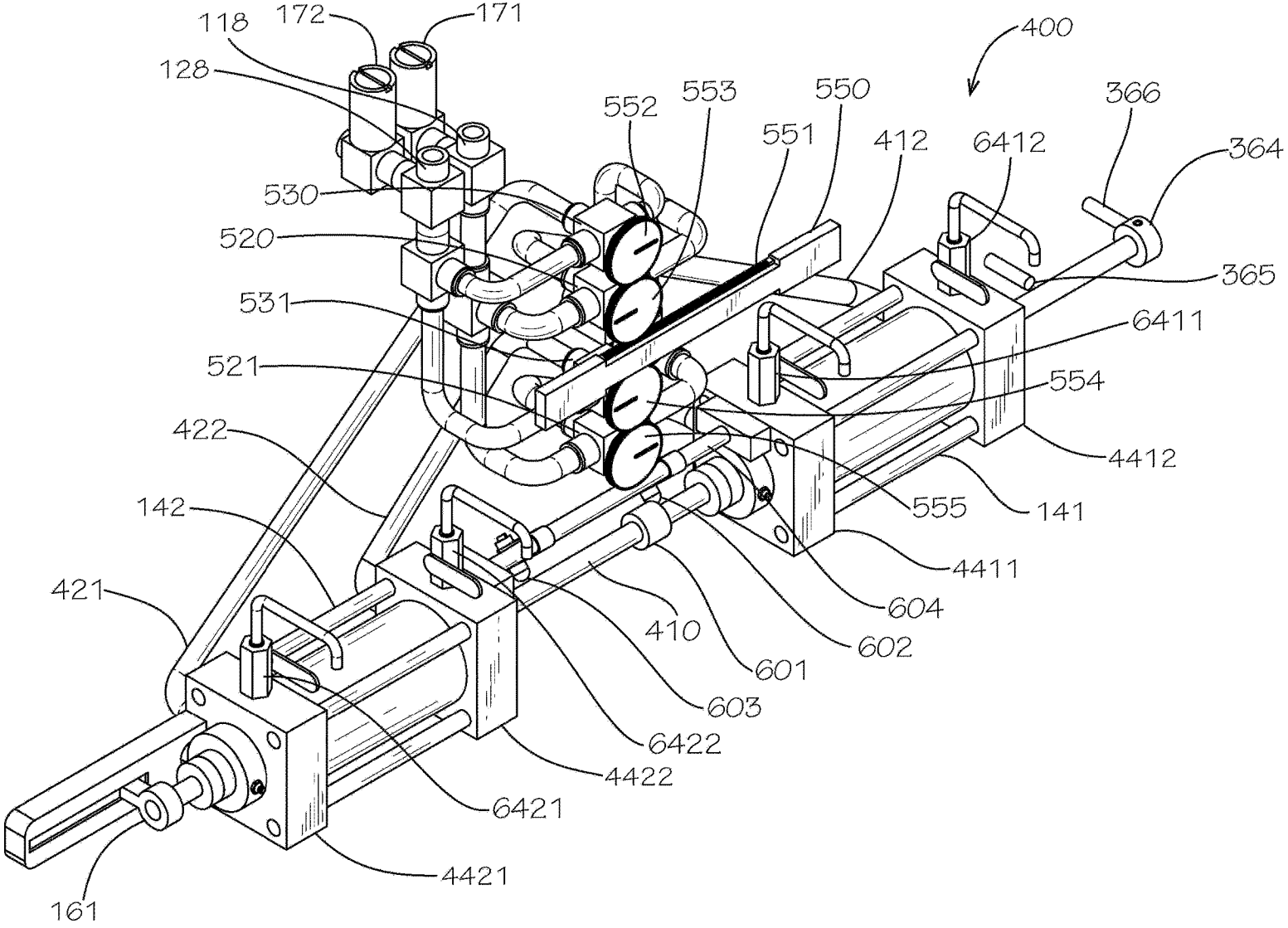
FIG. 6 is a left front top perspective view of the metering cylinder assembly of FIG. 4 with the actuators of the valve rack of the metering cylinder assembly removed for clarity.

As shown in FIG. 6, each of the upper valves 520, 530 and the lower valves 521, 531 can comprise a pinion gear defining teeth matching the teeth 551 of the actuator rack 550. More specifically, the upper valve 530 can comprise a pinion gear 552, the upper valve 520 can comprise a pinion gear 553, the lower valve 531 can comprise a pinion gear 554, and the lower valve 521 can comprise a pinion gear 555.

The metering cylinder assembly 400 can comprise a position flag 601, which can be positioned between the first metering cylinder 141 and the second metering cylinder 142 and be secured to or mounted around the rod 410. A first position sensor 602 and a second position sensor 603, which can be offset in an axial direction of the rod 410 from the first position sensor 602, can sense the presence of the position flag 601 and thereby sense and track movement of the rod 410. Either or both of the first position sensor 602 and the second position sensor 603 can be mounted to a sensor mount 604 with a fastener, which can comprise a clamp or a bracket. The position flag 601, the first position sensor 602, and the second position sensor 603 can be positioned relative to one another such that the first position sensor 602 and the second position sensor 603 can effectively sense the absolute end of travel of the rod 410, which can be the point at which the rod 410 stops and reverses direction.

The first metering cylinder 141 can comprise a first bleeder valve 6411 and a second bleeder valve 6412. Likewise, the second metering cylinder 142 can comprise a first bleeder valve 6421 and a second bleeder valve 6422. Either or both of the first bleeder valves 6411, 6421 or the second bleeder valves 6412, 6422 can facilitate manual removal of gas trapped inside the first ends 4411, 4421 or the second ends 4412, 4422 of the respective metering cylinders 141, 142.

Figure 7A:
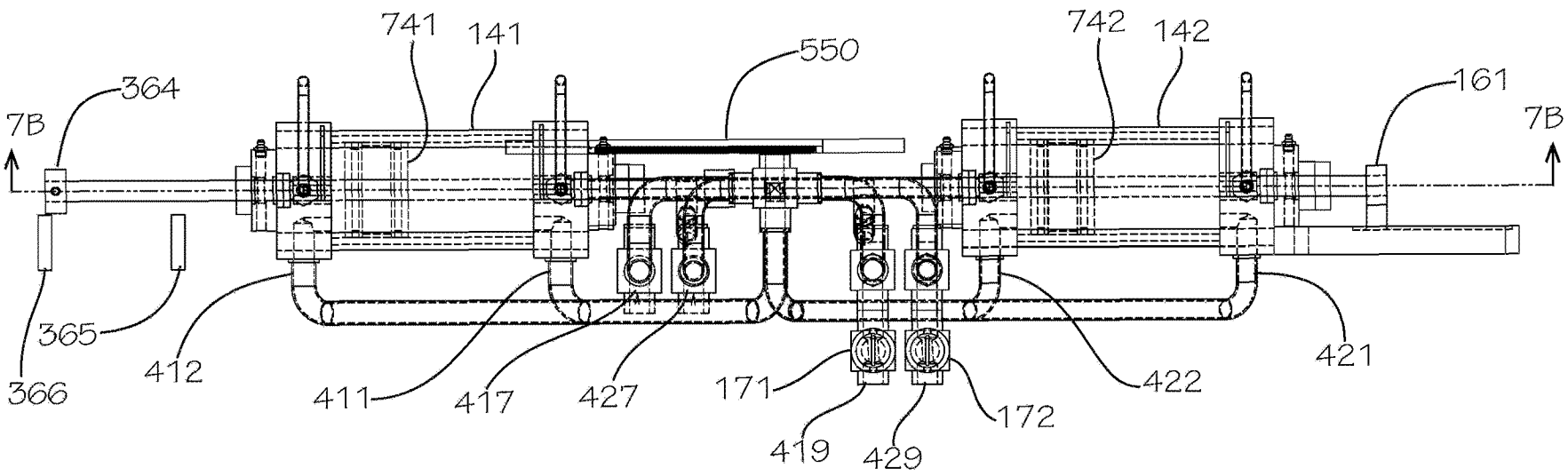
FIG. 7A is a top plan view of the metering cylinder assembly of FIG. 4 with some of the internal or otherwise hidden components of the metering cylinder assembly shown in broken lines.

As shown in FIG. 7A, which shows a top view of the metering cylinder assembly 400, the first metering cylinder 141 can comprise a first piston 741, and the second metering cylinder 142 can comprise a second piston 742.

Figure 7B:
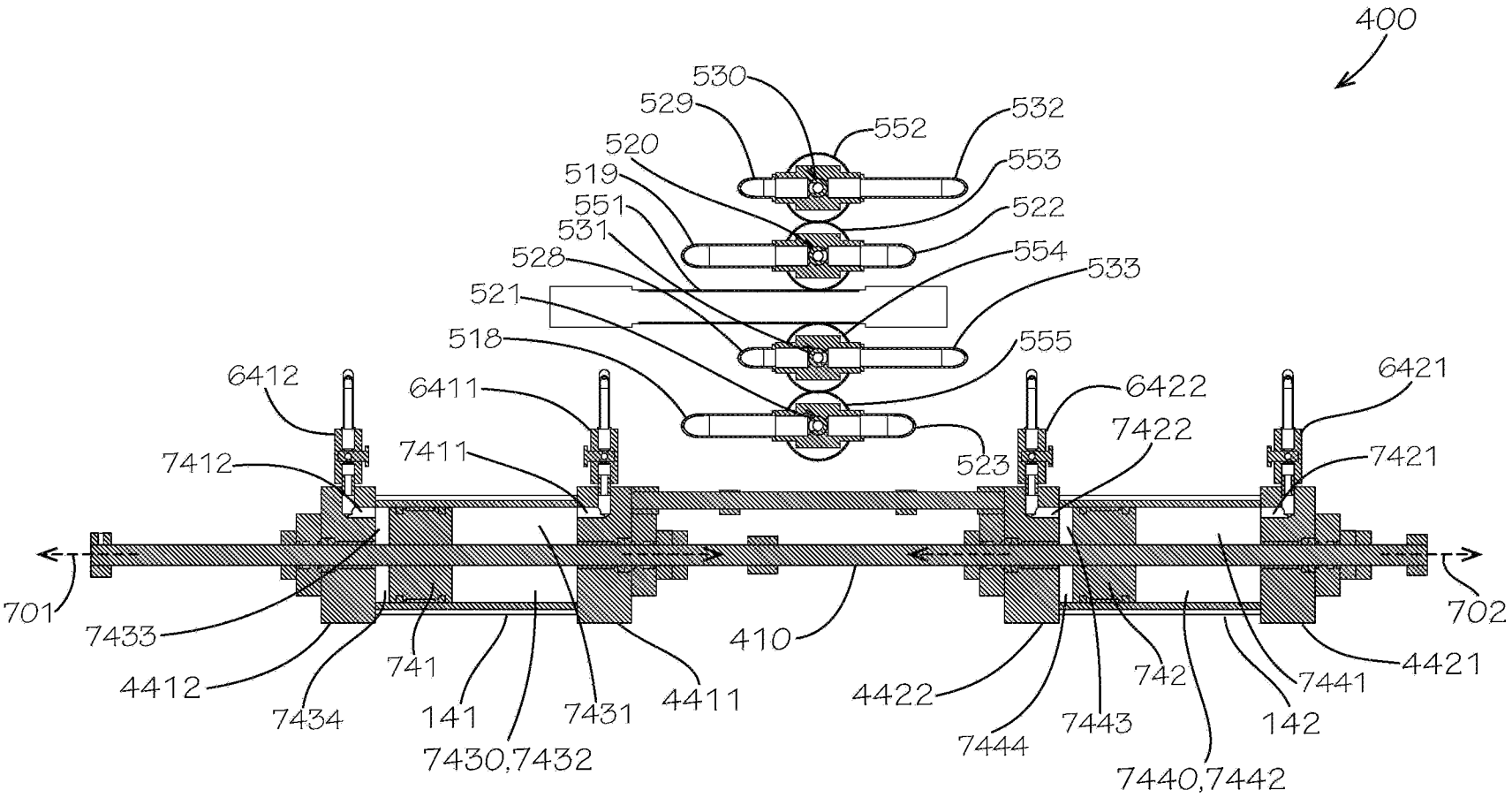
FIG. 7B is a sectional view of the metering cylinder assembly of FIG. 4 taken from line 7B-7B of FIG. 7A.

As shown in FIG. 7B, which shows a cross-section of the metering cylinder assembly 400, as will be described in more detail with respect to FIG. 13, a fluid such as the material 81, 82 inside the respective metering cylinder 141, 142 can have both a liquid portion and a gas portion.

On a first side of an interior cavity 7430 of the first metering cylinder 141 positioned between the first piston 741 of the first metering cylinder 141 and the first end 4411, a lighter portion 7431 of the first material 81 (shown in FIG. 12) can comprise rising entrapped gas, while a heavier portion 7432 of the first material 81 can comprise a settling liquid. On a second side of the first piston 741 of the first metering cylinder 141 opposite from the first side and proximate to the second end 4412, a lighter portion 7433 of the first material 81 can comprise rising entrapped gas, while a heavier portion 7434 of the first material 81 can comprise a settling liquid.

Likewise, on a first side of an interior cavity 7440 of the second metering cylinder 142 positioned between the second piston 742 of the second metering cylinder 142 and the first end 4421, a lighter portion 7441 of the second material 82 (shown in FIG. 12) can comprise rising entrapped gas, while a heavier portion 7442 of the second material 81 can comprise a settling liquid. On a second side of the second piston 742 of the second metering cylinder 142 opposite from the first side and proximate to the second end 4422, a lighter portion 7443 of the second material 82 can also comprise rising entrapped gas, while a heavier portion 7444 of the second material 82 can also comprise a settling liquid.

The first end 4411 of the first metering cylinder 141 can define a gas exit cavity 7411 fluidly connecting the first end of the interior cavity 7430 of the first metering cylinder 141 and the first bleeder valve 6411, and the second end 4412 of the first metering cylinder 141 can define a gas exit cavity 7412 fluidly connecting the second end of the interior cavity 7430 of the first metering cylinder 141 and the second bleeder valve 6412.

Likewise, the first end 4421 of the second metering cylinder 142 can define a gas exit cavity 7421 fluidly connecting the first end of the interior cavity 7440 of the second metering cylinder 142 and the first bleeder valve 6421, and the second end 4422 of the second metering cylinder 142 can define a gas exit cavity 7422 fluidly connecting the second end of the interior cavity 7440 of the second metering cylinder 142 and the second bleeder valve 6422.

A first cylinder axis 701 defined by the first metering cylinder 141 can be aligned with a second cylinder axis 702 defined by the second metering cylinder 142.

Figure 8:
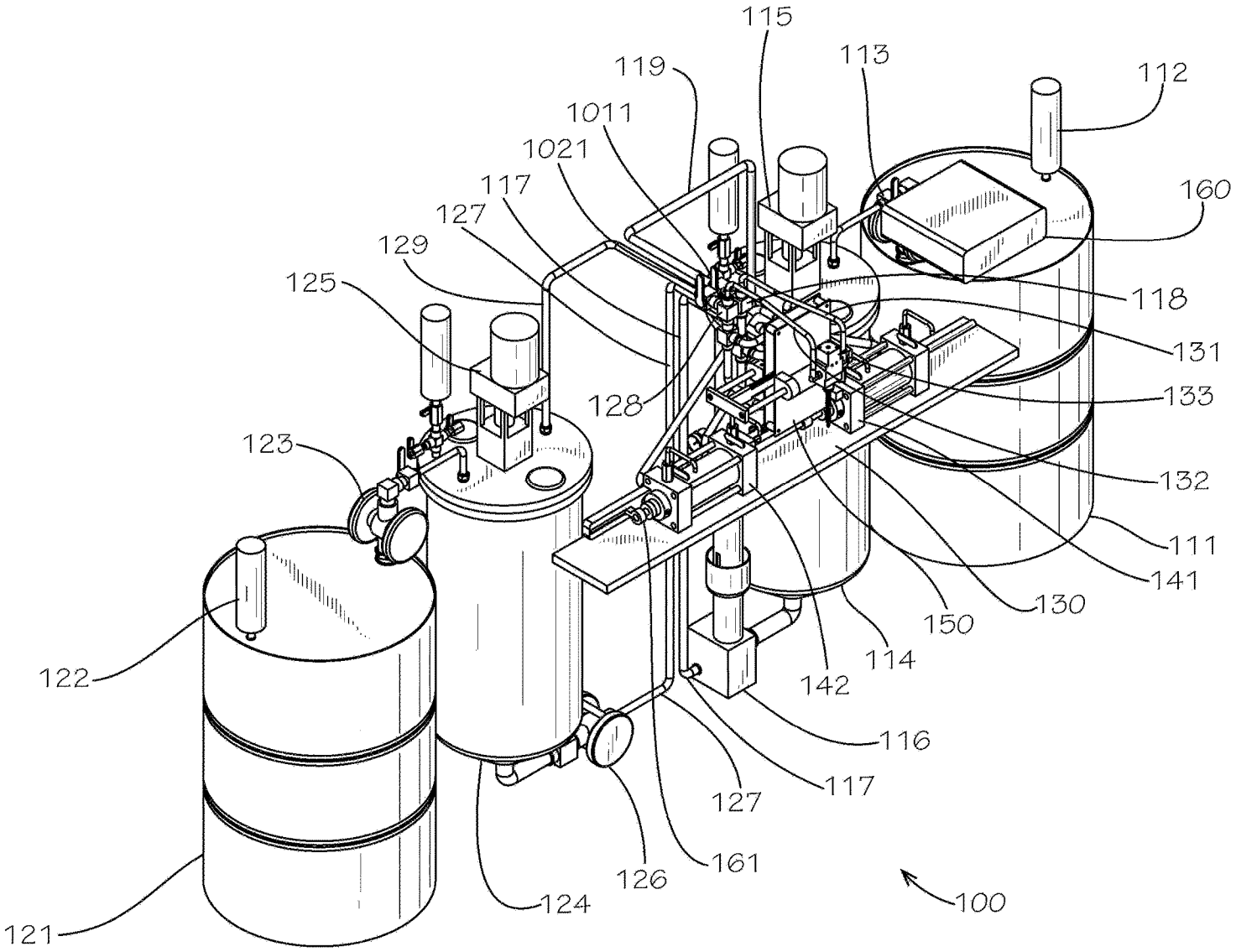
FIG. 8 is a left front top perspective view of the system of FIG. 1 in the dispensing condition in accordance with another aspect of the current disclosure in which the first recirculating valve and the second recirculating valve are configured for manual operation.

In some aspects, as described above, either of the recycling valves 171, 172 can be an electronic valve that is electronically operated. In other aspects, as shown in FIG. 8, either of the recycling valves 171, 172 can be replaced with a manually operated valve such as, for example and without limitation, a manual shut-off valve 1011, 1021 in the respective return pipe 119, 129. Each of the manual shut-off valves 1011, 1021 can be a recirculation valve. Either of the manual shut-off valves 1011, 1021 can be any valve able to manually regulate flow of the respective material 81, 82 into the return pipe 119, 129 such as, for example and without limitation, a 90-degree ball valve with a lever. As shown, each of the manual shut-off valves 1011, 1021 can be in a closed position, blocking such flow into and through the respective return pipe 119, 129. In some aspects, opening the manual shut-off valves 1011, 1021 can facilitate start temperature equalization of the system 100 and a general homogenization of the materials 81, 82 but is not intended to remove entrapped gas.

Figure 9:
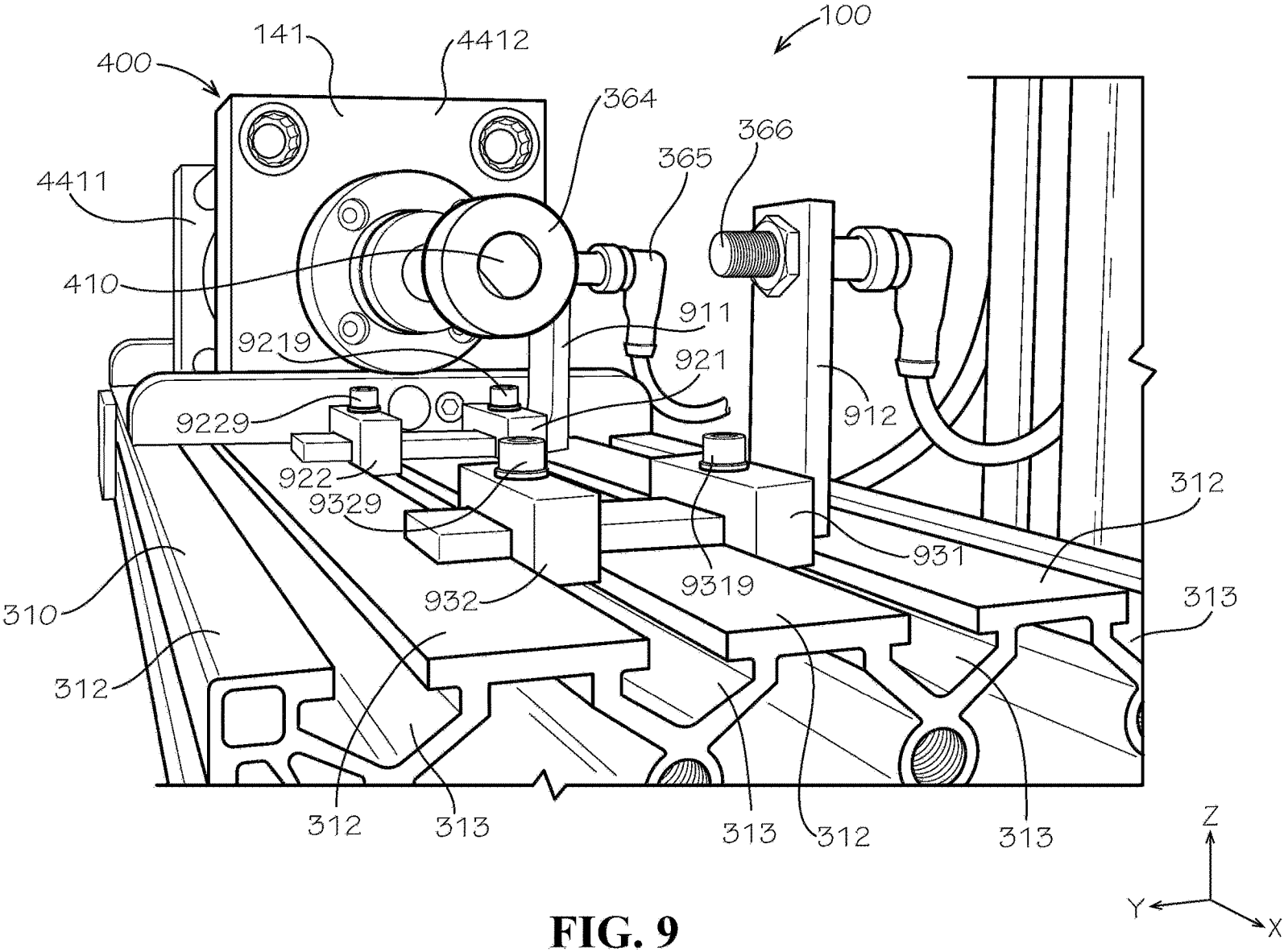
FIG. 9 is a side perspective view of a right end of the metering cylinder assembly of FIG. 4 showing a first metering cylinder of the metering cylinder assembly secured to a mounting bed proximate to a pair of proximity sensors.

As shown in FIG. 9, the metering cylinders 141, 142 (142 shown in FIG. 8) and the metering cylinder position sensors 365, 366 can be secured to the mounting bed 310 of the system 100. More specifically, the mounting bed 310 can comprise rails 312 and channels 313 with respect to which the metering cylinders 141, 142 and the metering cylinder position sensors 365, 366 can be gauged or positioned and secured. The metering cylinder position sensors 365, 366 can be secured to brackets 911, 912 with a respective fastener. The brackets 911, 912 can be secured to the mounting bed 310 with positioning blocks 921, 922 and positioning blocks 931, 932, respectively. The positioning blocks 921, 922 and the positioning blocks 931, 932 can be secured to the mounting bed 310 with respective fasteners 9219, 9229, 9319, 9329. By adjustment (e.g., loosening and readjustment) of fasteners such as, for example and without limitation, the fasteners 9219, 9229, 9319, 9329, the metering cylinder position sensors 365, 366 can be moved to and secured in any desired position in the X-axis, the Y-axis, or the Z-axis directions as shown relative to the rod 410 and the position flag 364 of the metering cylinder assembly 400.

Each of the metering cylinder position sensors 365, 366 can comprise a proximity sensor comprising, for example and without limitation, an electromagnetic coil for sensing the presence of a metal object such as the position flag 364. Each of the metering cylinder position sensors 365, 366 can be an inductive sensor in that the presence of the metal object being sensed need not touch the metering cylinder position sensor 365, 366 but simply be close enough to the metering cylinder position sensor 365, 366 to induce movement of a switch located inside the metering cylinder position sensor 365, 366.

Figure 10:
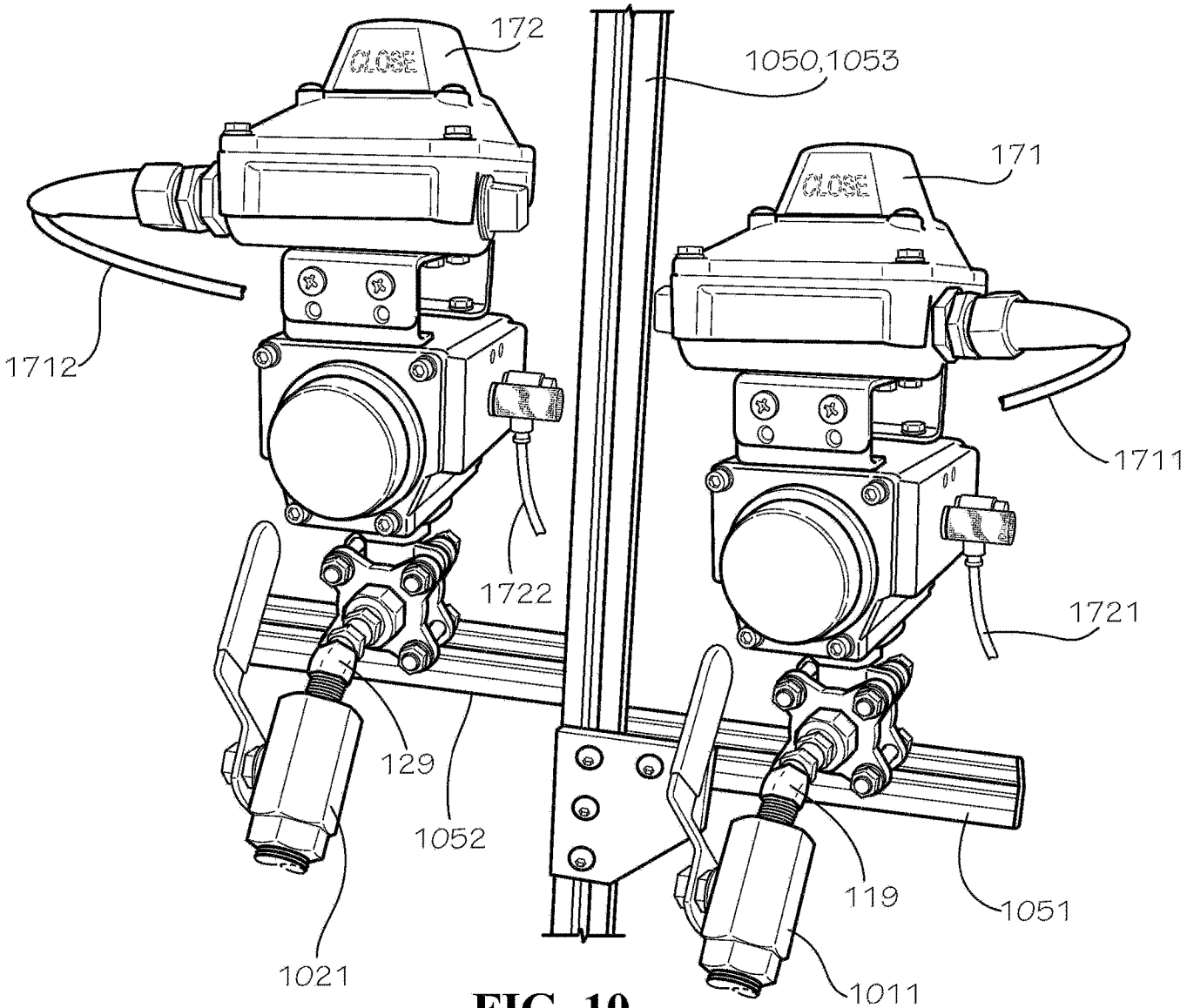
FIG. 10 is a perspective view of the pair of recirculation valves of the system of FIG. 1 in the dispensing condition.

As shown in FIG. 10, the recycling valves 171, 172 can be electronically controlled. The recycling valves 171, 172 can also be pneumatically powered. Each of the recycling valves 171, 172 can be a ball valve such as, for example and without limitation, the ball valve Model DM 340 available with either electric or pneumatic actuators from DuraValve, Inc. of Elk Grove, Ill. For example and without limitation, a control wire 1711, 1712, which can be connected to the respective recycling valves 171, 172 as shown, can be in electrical or electronic communication with the control system 160 or the recycling controller 363 to receive operations from and optionally provide feedback to the control system 160 or the recycling controller 363. In addition, the control wires 1711, 1712 can provide electrical power to the respective recycling valves 171, 172. A pneumatic line 1721, 1722, which can be connected to the respective recycling valves 171, 172 as shown, can be in fluid communication with a source of pressured air to facilitate actuation of the respective recycling valves 171, 172. As shown, the recycling valves 171, 172 can be installed in-line in the return pipes 119, 129. To facilitate back-up manual regulation of flow of the materials 81, 82 into and through the return pipes 119, 129, the system 100 can further comprise the manual shut-off valves 1011, 1021 in the return pipes 119, 129. Either or each of the manual shut-off valves 1011, 1021 can be, for example and without limitation, a ball valve with a lever as shown.

The weight of any or all of the recycling valves 171, 172, the return pipes 119, 129, and the manual shut-off valves 1011, 1021 can be supported by a support 1050, which can comprise support members 1051, 1052, 1053. Horizontal support members 1051, 1052 can support such weight and can be themselves mechanically secured to a vertical support member 1053. As shown, each of the support members 1051, 1052, 1053 can be a rail or a bar and can be joined to each other with brackets or fasteners or both. In some aspects, the weight and rigidity of the recycling valves 171, 172, the return pipes 119, 129, and the manual shut-off valves 1011, 1021 and the connections therebetween can maintain the position of each component relative to the support 1050. In other aspects, additional fasteners can be used to secure the recycling valves 171, 172 to the support 1050.

Figure 11:
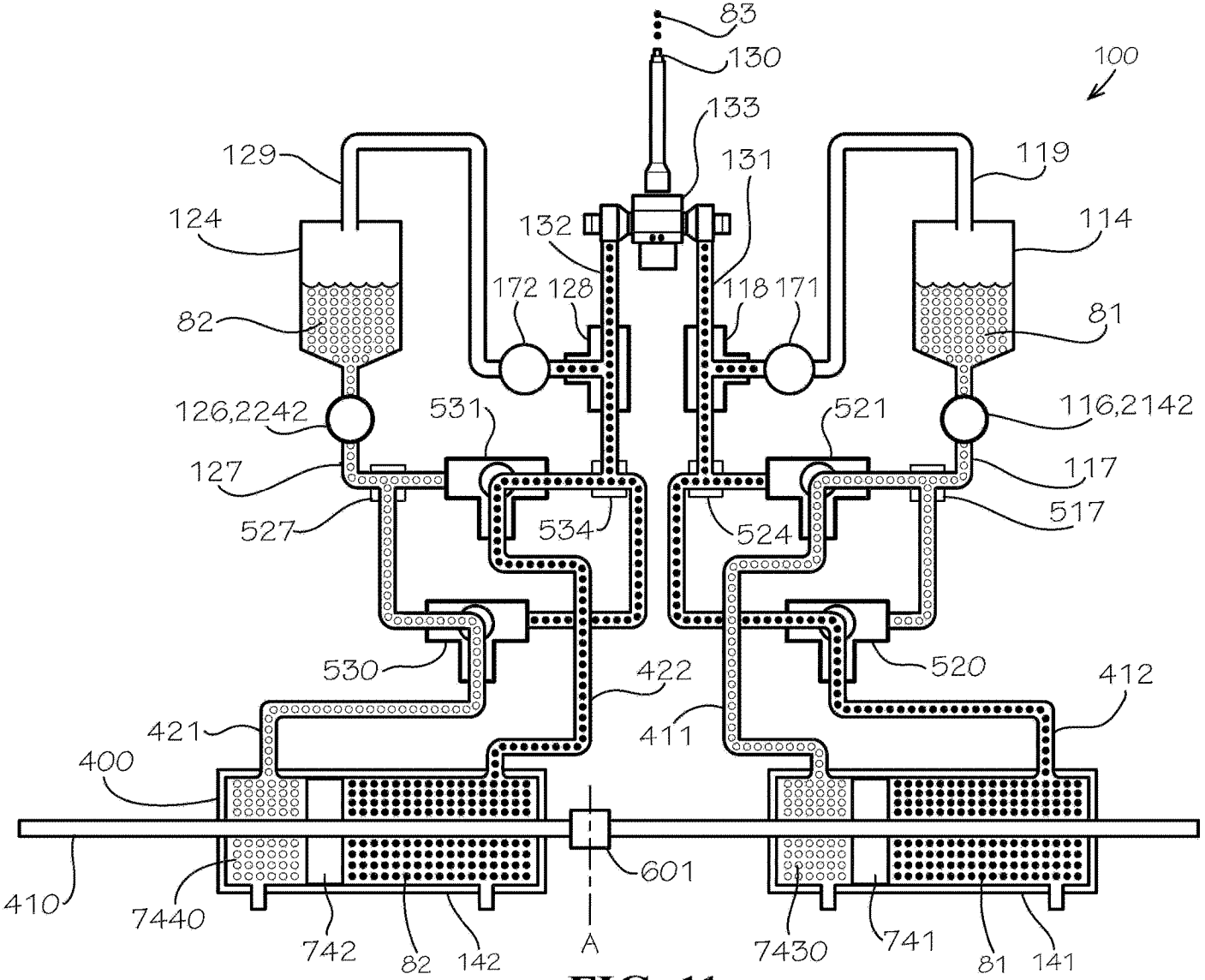
FIG. 11 is a schematic view of the system of FIG. 1 in the dispensing condition with a flag of a rod of the metering system assembly at a first stroke position A and moving towards the right.

As shown in FIG. 11, a schematic view of the system 100 in the dispensing condition, the second metering cylinder 142, which can be connected to the first metering cylinder 141 as shown, can by such connection be configured to move from a first stroke position A—which can be measured to a centerline of the position flag 601—to a second stroke position B (shown in FIG. 12) in unison with the first metering cylinder 141. As such movement occurs, both the first material 81 and the second material 82 are effectively—and simultaneously—pushed through the system 100 and ultimately to and through the dispensing head 133. At the same time, the delivery pumps 116, 126 can resupply the material 81, 82 to the opposite side of the respective metering cylinders 141, 142. As shown, the recycling valves 171, 172 are in a closed position and the dispensing head 133 is in an open position. As the first material 81 and the second material 82 flow through the dispensing head 133, the first material 81 and the second material 82 can be progressively and thoroughly blended inside a static mixing portion of the dispensing nozzle 130 and exit as the mixture 83, which can be a homogenous mixture such as the potting material or casting resin previously described.

Figure 12:
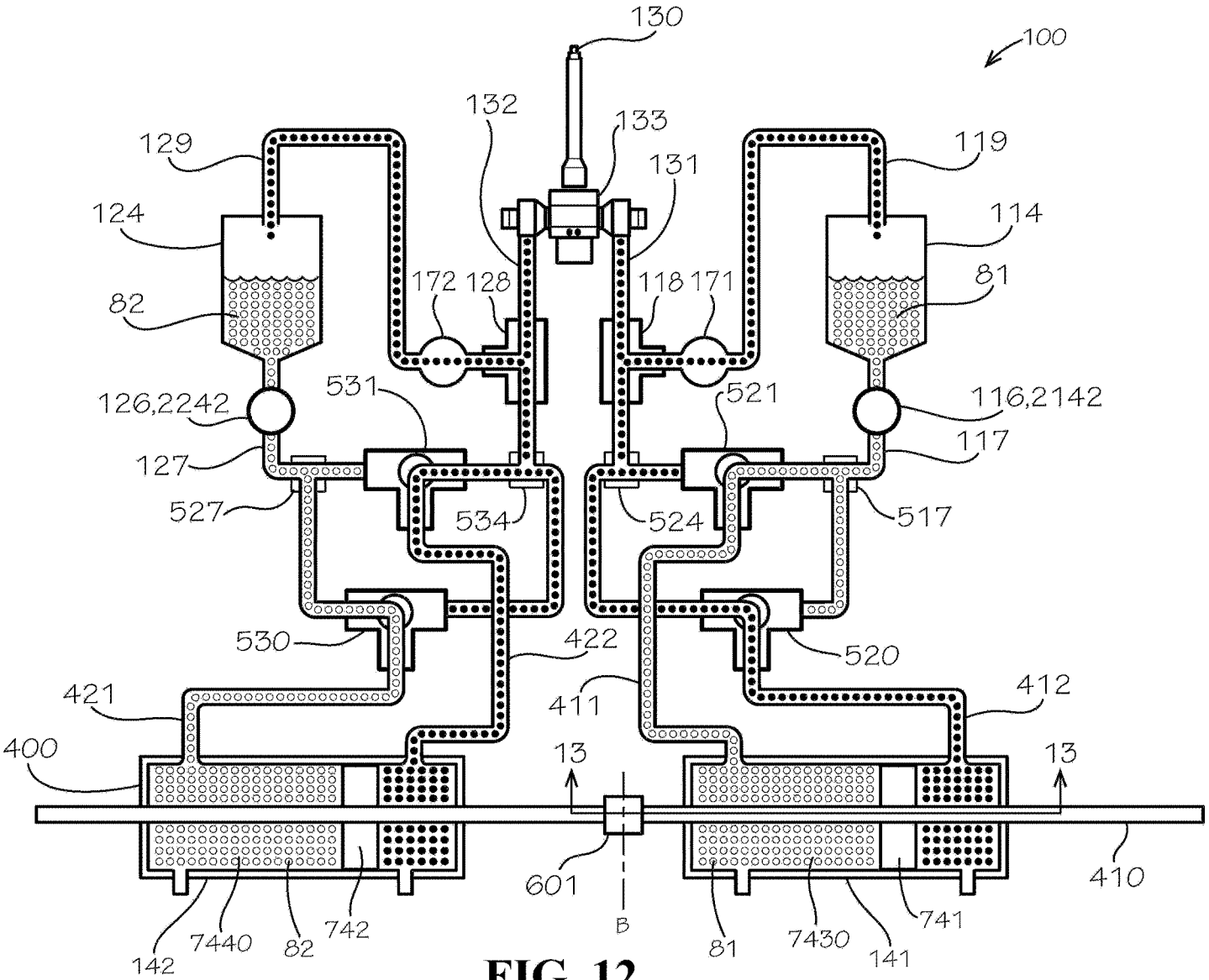
FIG. 12 is a schematic view of the system of FIG. 2 in the recycling condition with the flag of the rod of the metering system assembly at a second stroke position B and still moving towards the right.

As shown in FIG. 12, a schematic view of the system 100 in the recycling condition, the recycling valves 171, 172 are in an open position and the dispensing head 133 is in a closed position. As the first material 81 and the second material 82 flow towards the closed dispensing head 133, the presence of the first material 81 and the second material 82 filling the respective feeder pipes 131, 132 causes the first material 81 and the second material 82 now flowing from the respective metering cylinders 141, 142 to be diverted through the now open recycling valves 171, 172, through the return pipes 119, 129, and back into the respective preparation tanks without disturbing the first material 81 and the second material 82 filing the respective feeder pipes 131, 132.

Figure 13:
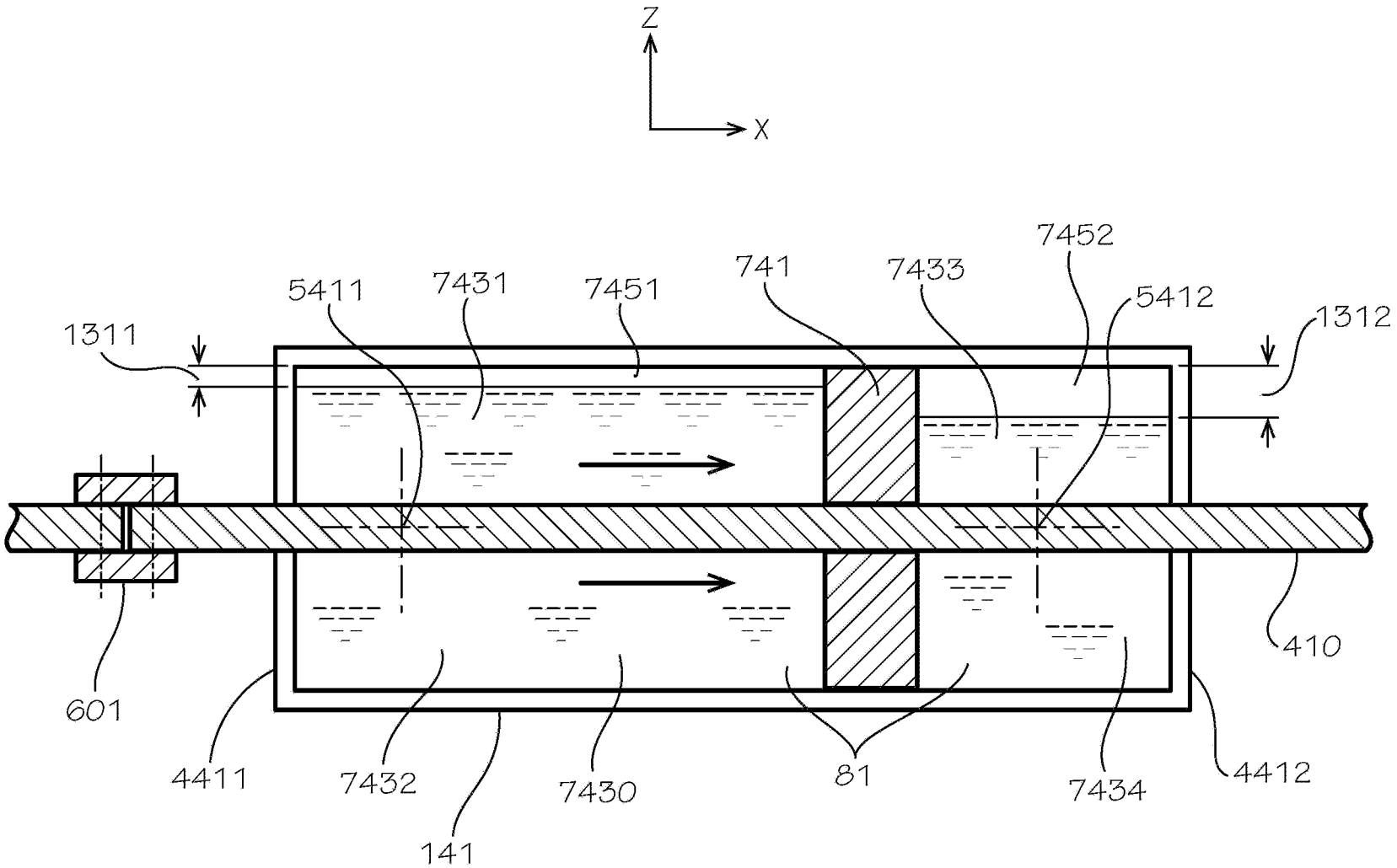
FIG. 13 is a detail view of a metering cylinder of the metering cylinder assembly of FIG. 4 taken from line 13-13 of FIG. 12.

As shown in FIG. 13, the representative metering cylinder 141 (representative of both the first metering cylinder 141 and the second metering cylinder 142) is shown in schematic form. The piston 741 can move in the X-axis direction proximate to the second stroke position B (shown in FIG. 12). As the piston 741 moves from the first end 4411 to the second end 4412 of the first metering cylinder 141, the liquid in the first material 81 can settle towards the bottom of the interior cavity 7430 and gas present in the first material 81 can rise towards the top of the interior cavity 7430. In effect, the lighter portion 7431 of the first material 81 can comprise rising entrapped gas, while the heavier portion 7432 of the first material 81 can comprise the settling liquid. Likewise, on the opposite or second side of the first piston 741, the lighter portion 7433 of the first material 81 can comprise rising entrapped gas, while the heavier portion 7434 of the first material 81 can comprise the settling liquid. As the liquid portion of the first material 81 settles and the gas portion or gas pocket of the first material 81 rises on each side of the piston 741, a gas portion 7451 can form on the first side of the piston 741 and a gas portion 7452 can form on the second side of the piston 741. The gas portion 7451 can occupy a space having a height 1311 measured in cross-section, which as shown can be representative of the relative volume of the entrapped gas bubbles in the fluid, or vertically from an uppermost portion of the interior cavity 7430 of the metering cylinder 141 to the top of the liquid portion of the first material 81 on the first side of the piston 741, while the gas portion 7452 can occupy a space having a height 1312 measured in cross-section, which likewise as shown can be representative of the relative volume of the entrapped gas bubbles in the fluid, or vertically from an uppermost portion of the interior cavity 7430 to the top of the liquid portion of the first material 81 on the second side of the piston 741.

As described above, the representative first material 81, which can consist of a mixture of the lighter portion 7431 and the heavier portion 7432, can be delivered in a pressurized state into the interior cavity 7430 via the first transfer port 5411 on the first side of the first piston 741 via the first delivery pump 116. In certain conditions, such as, for example and without limitation, when the second delivery pump 126 is operating simultaneously, the first recycling valve 171 is opened, and the second recycling valve 172 is simultaneously opened, a pressure drop can be created in the interior cavity 7430 on the second side of the first piston 741. Such a pressure drop can create a lower differential pressure inside the material 81 located on the second side of the piston 741, which can cause the immediate expansion of the gas portion 7452 of the first material 81 (which can consist of a mixture of its lighter portion 7433 and heavier portion 7434). As will be described below, the material 81 can be discharged through the operatively opened second transfer port 5412 and the lighter portion 7433 sent back to the preparation tank 114 for recycling.

As the piston 741 pushes the liquid portion of the first material 81 out of the first metering cylinder 141 through the second transfer port 5412, the height 1312 can increase due to the gas portion 7452 being a greater and greater percentage of the increasingly smaller volume of the interior cavity 7430 on the second side of the piston 741. Eventually, the gas portion can begin to be pushed out of the first metering cylinder 141 through the second transfer port 5412, thereby introducing gas into the otherwise homogeneous liquid material 81 present in the transfer pipe 412 (shown in FIG. 12).

When the dispensing valve of the dispensing head 133 is kept open in such conditions, such trapped gas can travel as part of the first material 81 through the feeder pipe 131 to the dispensing head and be dispensed through the dispensing nozzle 130. Simultaneously, because of a similar process occurring in and as a result of movement of the piston 742 in the second metering cylinder 142, trapped gas can theoretically also travel as part of the second material 82 through the dispensing pipe 132 to the dispensing head and be dispensed through the dispensing nozzle 130 after mixing with the first material 81. It is theoretically possible but unlikely that the first material 81 and the second material 82 would be identically "contaminated" with trapped gas and still mix in the proper ratio to produce the mixture 83 having not only desirable properties but the intended properties. The existence of all of the following conditions, for example, could cause such a result: the liquid portion of the first material 81 and the liquid portion of the second material 82 having identical properties, including especially viscosity or resistance to flow; the first material 81 and the second material 82 having an identical percentage of trapped gas; identical distribution of any trapped gas throughout each of the first material 81 and the second material 82 throughout transport of the materials 81, 82 through the system 100; and simultaneous operation (i.e., simultaneous cycling ON and OFF) of the delivery pumps 116, 126.

In a typical use of the system 100, however, the characteristics of the first material 81, the second material 82, and the system 100 itself are not so aligned. First, as noted above the first material 81 and the second material 82 do not typically have identical properties, including in the area of viscosity. Again, the system 100 can be used to dispense a potting material into an assembly such as, for example and without limitation, an assembled electrical or electronics component such as a relay, a motor, or a water meter antenna or register assembly, in order to stabilize and protect by encapsulation or lamination the component against liquid intrusion that might adversely affect the operation of the component or shorten its life. For example, such a mixture 83 can be an epoxy (as more broadly characterized) or a polyurethane (as more narrowly characterized) potting material or casting resin formed by a mixture of a polyol resin and an isocyanate "hardener" material. In order to create the mixture 83 having the desired properties from the first material 81 and the second material 82, the two materials can in some instances have very different properties. The inherent differences between the materials 81, 82 and the limitations of the systems in which they are typically dispensed, however, can make it challenging to consistently and reliably mix and dispense the materials 81, 82 at the required ratio.

In other aspects, in addition to the use of potting materials in an assembled electrical component, potting materials can be used in a wide variety of other products and industries. For example an without limitation, epoxy and other casting resins including the mixture 83 described herein can be used to fabricate composite material structures such as is common in the manufacture of wings and many other structural components of aircraft, wind turbine blades, helmets, boats, racing chasses—such as used in FORMULA ONE class racing. In some aspects, as described above, the casting resin resulting from the mixture 83 can simply cover or surround the material. In other aspects, such as when using the casting resin to build an aircraft wing, a fibrous material such as, for example and without limitation, carbon fiber or fiberglass can be impregnated with the casting resin and built in layers. In other aspects, mixtures of the materials 81, 82 (and mixtures comprising more than the two materials 81, 82) dispensed using any of the structures or methods described herein can be used in the manufacture of other products such as, for example and without limitation, pharmaceuticals, food products, nutritional aids, and munitions.

In some aspects, in a typical dispensing system, the target mixture 83 can be a 50/50 or 1:1 ratio mixture of the materials 81, 82. This same typical dispensing system 100 operated without any of the improvements described herein, however, can regularly dispense an "off-ratio" mixture 83 in every cycle of operation or every stroke of the respective piston 741, 742—typically beginning near an end of a direction stroke of each metering cylinder assembly 400. One effect of the mixture 83 being "off-ratio" is that the mixture 83 cannot properly and fully cure and can fail to provide the protection that the component requires. Because of the way in which the mixture 83 fills, surrounds, coats, and permanently adheres to the components of an assembly, an off-ratio mixture 83, not having the require properties, can effectively result in any component manufactured with it being utterly unusable and subsequently scrapped at an unacceptably high cost to a manufacturer. If a product that has been assembled with an off-ratio potting material is not identified as such before reaching a customer or end user, other negative consequences can result. In the case of a structural component fabricated with a casting resin such as the mixture 83, an off-ratio mixture 83 can result in failure of the component including, but not limited to, delamination or buckling of individual layers or the entire assembled part.

As an example of the challenges of dispensing the mixture 83, a viscosity of the first liquid 81 can be substantially different than a viscosity of the second liquid 82. For example and without limitation, the first material 81, which can be the polyol resin material, can have a viscosity of 3,200 centipoise (cps) at 25° C.; in contrast, the second material 82, which can be the isocyanate material, can have a viscosity of only 130 cps under the same conditions. Therefore, the polyol resin or "Part A" material can have a viscosity that is nearly 25 times the viscosity of the isocyanate or "Part B" material, even though the density of the polyol resin, which can measure 7.7 lbs./gallon (0.92 g/cm$^3$), can actually be less than that of the isocyanate, which can measure 8.3 lbs./gallon (0.99 g/cm$^3$), and the specific gravity, at 0.91, can be less than that of the isocyanate, at 1.00). In some aspects, therefore, the viscosity of the first liquid 81 can be between 24 and 25 times the viscosity of the second liquid 82. In other aspects, the viscosity of the first liquid 81 can be at least 20 times the viscosity of the second liquid 82. In other aspects, the viscosity of the first liquid 81 can be at least 15 times the viscosity of the second liquid 82. In other aspects, the viscosity of the first liquid 81 can be at least 10 times the viscosity of the second liquid 82. In other aspects, the viscosity of the first liquid 81 can be at least five times the viscosity of the second liquid 82. In other aspects, the viscosity of the first liquid 81 can be at least two times the viscosity of the second liquid 82. In other aspects, the viscosity of the first liquid 81 can be the same as the viscosity of the second liquid 82. In other aspects, the viscosity of the first liquid 81 can be less than the viscosity of the second liquid 82. In other aspects, the viscosity of the first liquid 81 can be more than 25 times the viscosity of the second liquid 82. In any case, when a material such as the material 81, 82 has a higher viscosity, there can be an increased risk of creating a vacuum when pumping the material because the material can be effectively drawn from one part of the system (for example, the preparation tank 114) faster than it can readily flow because of its relatively high viscosity. Such a vacuum within the system 100 can cause any entrapped gasses to separate from the liquid portion of the material, created a gas pocket, which as described herein can result in an off-ratio mixture 83 because a portion of the material 81, 82, which should be a liquid, is displaced in part by a gas—and gas that can occupy more volume than any corresponding liquid.

As another example of the challenges of dispensing the mixture 83, the first material 81 and the second material 82 can comprise trapped gas of different percentages. For example only, various batches of either of the first material 81 and the second material 82 manufactured at different times can for various reasons be manufactured or stored under varying conditions and yet each batch still remain within recommended tolerances for that particular material 81, 82. In addition, either of the materials 81, 82 can be purchased from one supplier at one point in time and then from another supplier at another point in time, in which case the different suppliers can produce materials 81, 82 having the substantially similar if not identical chemical properties. Yet material purchased from the one supplier can have more or less trapped gas than material purchased from the other supplier. In fact, the first material 81 can have a materially significant percentage of trapped gas and the second material can have none at all, and vice versa. There can be economic or other reasons for this. In any case, any gas trapped inside either the first material 81 or the second material 82 can, moreover, be distributed unevenly throughout each of the first material 81 and the second material 82, respectively, such that pockets of trapped gas can be present inside the materials 81, 82, which can otherwise be homogenous liquids comprising only the Part A and Part B components themselves.

As yet another example of, while not necessarily the only other reason for, the challenges of dispensing the mixture 83, the delivery pumps 116,126 do not typically operate simultaneously (i.e., simultaneously cycling ON and OFF) during operation of the typical system 100—including in the system 100 described herein. As described below, a cycle timing of the first pump can be not synchronized with a cycle timing of the second pump. A cycle timing of two pumps are not synchronized, non-synchronous, or asynchronous, when the ON and OFF cycles of the pumps begin at different times during their operation. For example, the first delivery pump 116 can have a 4:1 pressure ratio, and the second delivery pump 126 can have a 1:1 pressure ratio. Using pumps with different pump pressure ratios can be helpful when pumping materials 81,82 having different viscosities. For example, a higher ratio pump can in some cases pump through the system 100 a higher viscosity material such as the first material 81 more effectively, while a lower ratio pump can suffice for pumping of the second material 82. Even with identical type pumps, even slightly non-synchronous operation of the pump cycles from the start of operation or over time due to wear or other factors can cause the first material 81 to flow at a point in time when the second material 82 is stationary, and vice versa. With the delivery pumps 116,126 being different pump types, however, non-synchronous operation can have a greater effect. Not only can the pump ON and OFF cycles be offset from one another from the start of operation of the system 100, but due to the difference in operation (including the number of cycles per given time period, for example), there can be multiple times (e.g., 5, 10, 20, or even more times) within a single stroke of the metering cylinder 400 in which the first material 81 is flowing or pulsing (flowing at a greater rate) at a time that the second material 82 is stationary or flowing at a lesser rate, and vice versa.

Each time that either the first metering cylinder 141 or the second metering cylinder 142 is moving and yet the first material 81 or the second material 82, respectively, is stationary, gas in the form of bubbles inside the first material 81 and the second material 82 can be formed. Without removal of the gas that can be trapped in the materials 81, 82 as drawn from the respective preparation tanks 114, 124 or as can develop in the materials 81, 82 during pumping of the materials 81, 82 through the system 100, the aforementioned off-ratio mixture 83 can result. While the bleeder valves 6411, 6412, 6421, 6422 can facilitate manual removal of gas from the metering cylinders 141, 142, manual removal of trapped gas from the materials 81, 82 through the bleeder valves 6411, 6412, 6421, 6422 not only can require worker skill and time (and inevitably introduce the possibility of human error into the process), but productivity of the overall process (for example, as measured by a total number of the assemblies being filled with the potting material) can be impacted, which can result in even greater costs.

Again, in some aspects, the target mixture 83 can be a 50/50 or 1:1 ratio mixture of the materials 81, 82. It can in some cases be acceptable for the first material 81 to be greater in volume or less in volume than the volume of the second material by 5%, but beyond this range the mixture can become unusable. By operating the electronically controlled recycling valves 171, 172 disclosed herein, a user can be guaranteed that 100% of the mixture 83 is within the required range by removing the gas trapped in the lines and more specifically in the metering cylinders 141, 142, even if some variance in the ratio from an exact 50/50 ratio is not possible for some of the reasons stated above. As will be described in more detail below, during the time that trapped gas is likely to introduced into the portion of the system 100 proximate to the dispensing head 133, the control system 160 or the recycling controller 363 can be set to automatically close or "lock" the dispensing head 133 and simultaneously open the recycling valves 171, 172 in order to draw the respective material 81, 82—with or without the trapped gas—back into the respective preparation tanks 114, 124. No matter the cost of the materials 81, 82 but especially if the cost is not insignificant, such redirection of the materials 81, 82 effectively means that no material is wasted; rather it is reused during subsequent operation of the system 100. In other aspects, as will be described below, other mixture ratios and ratio tolerances can be accommodated.

Because of this reuse of the material 81, 82, the trigger point for recirculation to begin—by closing the dispensing head 133 and opening the recycling valves 171, 172—can be made far enough away from the end of the stroke of the metering cylinder assembly 400 that the risk of gas remaining trapped in the materials 81, 82 as the materials 81, 82 flow through the dispensing head 133 is at an acceptable level. In some aspects, the recycling valves 171, 172 can open at a position equal to 92% of the cylinder stroke position, though the position can be above or below 92% in other aspects depending on, for example and without limitation, the properties of the materials 81, 82.

In a typical system without any of the improvements described herein, an off-ratio mixture 83 can be manually captured in containers at the end of each stroke and then discarded. This discarded material can amount to as much as 8-10% or more of the material initially in the supply containers 111, 121. When the dispensing head 133 is closed and the manual shut-off valves 1011, 1021 are open, however, any gas trapped in the material 81 together with the material 81 in which that gas is trapped can in some cases be diverted through the manual shut-off valves 1011, 1021, through the return pipes 119, 129, and back into preparation tanks 114, 124, respectively. As is noted elsewhere, however, this apparent removal of trapped gas from the materials 81, 82 may be quickly reintroduced into the materials 81, 82 and is neither automatic nor guaranteed to be effective. Due to the presence of trapped gas, the material 81 that is actually mixed with the material 82 being simultaneously pushed through the system 100 can actually be less than required to ensure a 50/50 mixture of the two materials 81, 82.

When the piston 741 changes direction and pushes the liquid portion of the first material 81 out of the first metering cylinder 141 through the second transfer port 5412, the height 1312 can increase due to the gas portion 7452 being a greater and greater percentage of the increasingly smaller value on the second side of the piston 741. Eventually, the gas portion can begin to be pushed out of the first metering cylinder 141 through the second transfer port 5412, therefore introducing gas into the otherwise homogeneous liquid material 81 present in the transfer pipe 412 (shown in FIG. 12).

Figure 14:
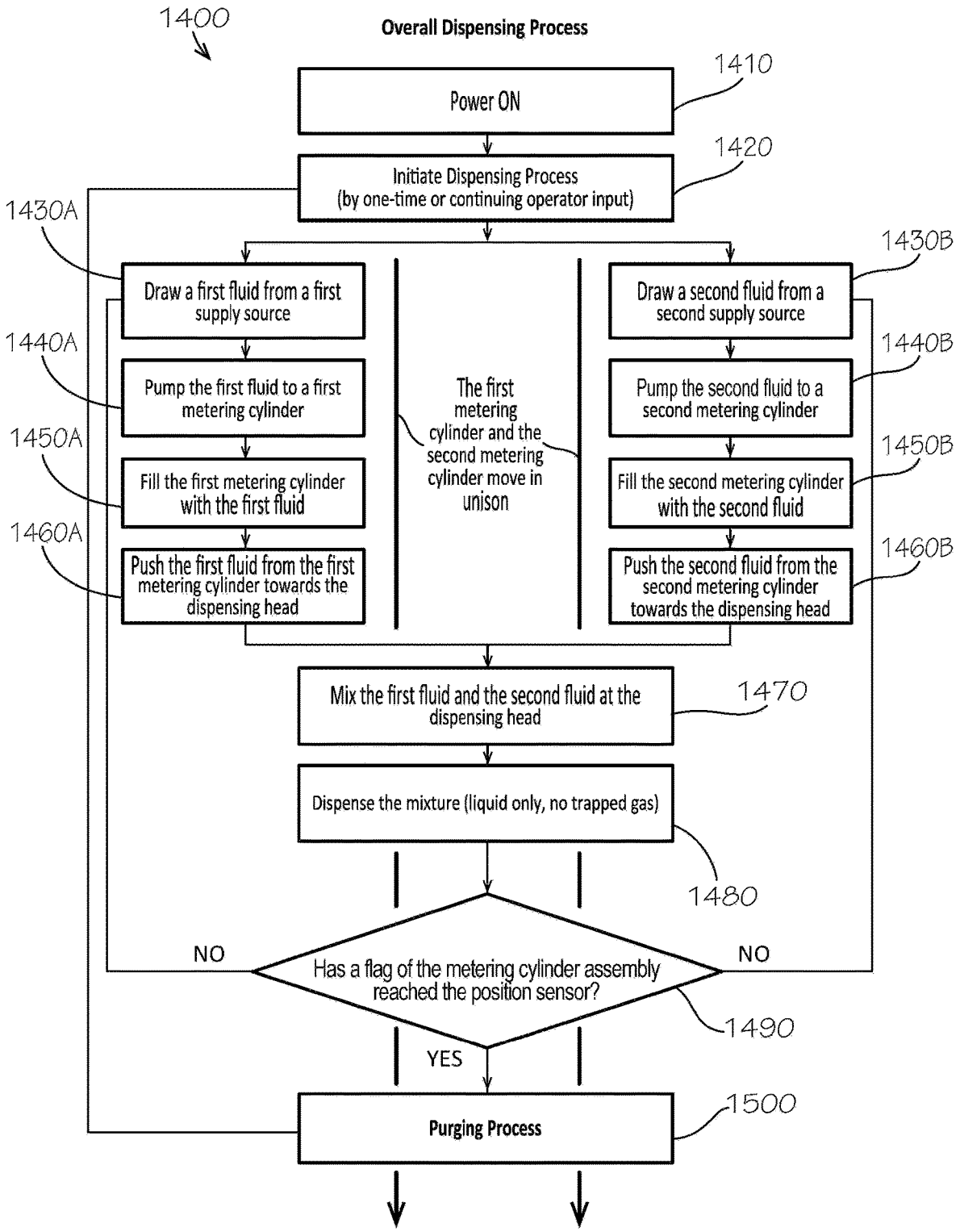
FIG. 14 is a flowchart describing an overall dispensing process of the system of FIG. 1.

As shown in FIG. 14, an overall process 1400 for dispensing the mixture 83 of the materials 81, 82 can comprise any one or more of the following steps. As shown in FIG. 14, each of the materials 81, 82 can be a fluid. The dispensing process 1400 can comprise moving the first metering cylinder 141 and the second metering cylinder 142 in unison throughout from a first stroke position such as the first stroke position A to a second stroke position such as the second stroke position B, or vice versa. A step 1410 can comprise supplying and activating power to the system 100. A step 1420 can comprise initiating a dispensing process, which can be by one-time or continuing operator input, the latter by a component such as, for example and without limitation, the aforementioned foot switch or any other switch. Respective steps 1430A,B can comprise drawing a first material 81 from a first supply source such as, for example and without limitation, the first supply container 111 and drawing the second material 82 from a second supply source such as, for example and without limitation, the second supply container 121. Respective steps 1440A,B can comprise pumping the first material 81 from the first supply source to the first metering cylinder 141 and pumping the second material 82 from the second supply source to the second metering cylinder 142. Respective steps 1450A,B can comprise filling the first metering cylinder 141 with the first material 81 and filing the second metering cylinder 142 with the second material 82. Respective steps 1460A,B can comprise pushing the first material 81 from the first metering cylinder 141 towards the dispensing head 133 and pushing the second material 82 from the second metering cylinder 142 towards the dispensing head 133. A step 1470 can comprise mixing the first material 81 and the second material 82 at the dispensing head 133 or after passing through the dispensing head and entering the dispensing nozzle 130. A step 1480 can comprise simultaneously dispensing each of the first material 81 and the second material 82 from the dispensing head 133 through the dispensing nozzle 130. More specifically, dispensing each of the first material 81 and the second material 82 from the dispensing head 133 can comprise dispensing a polyurethane epoxy material from a dispensing nozzle 130.

At this stage, however, the mixture 83 can be a liquid only, i.e., without any significant portion of trapped gas. More specifically, where the materials 81, 82 separately have a 5% mixture tolerance upon receipt from a supplier and initial incorporation into the system, the system described herein can reduce the percentage of trapped gas in the mixture 83 to less than one percent—in contrast to such a percentage being nine percent or more with a system not comprising the improvements described herein. A step 1490 can comprise determining whether a position flag such as, for example and without limitation, the position flag 364 of the metering cylinder assembly 400 has reached a position sensor such as, for example and without limitation, the position sensor 366. A purging process 1500 can comprise purging gas from the materials 81, 82 flowing through the system 100 before such gas is effectively dispensed with the materials 81, 82.

Figure 15:
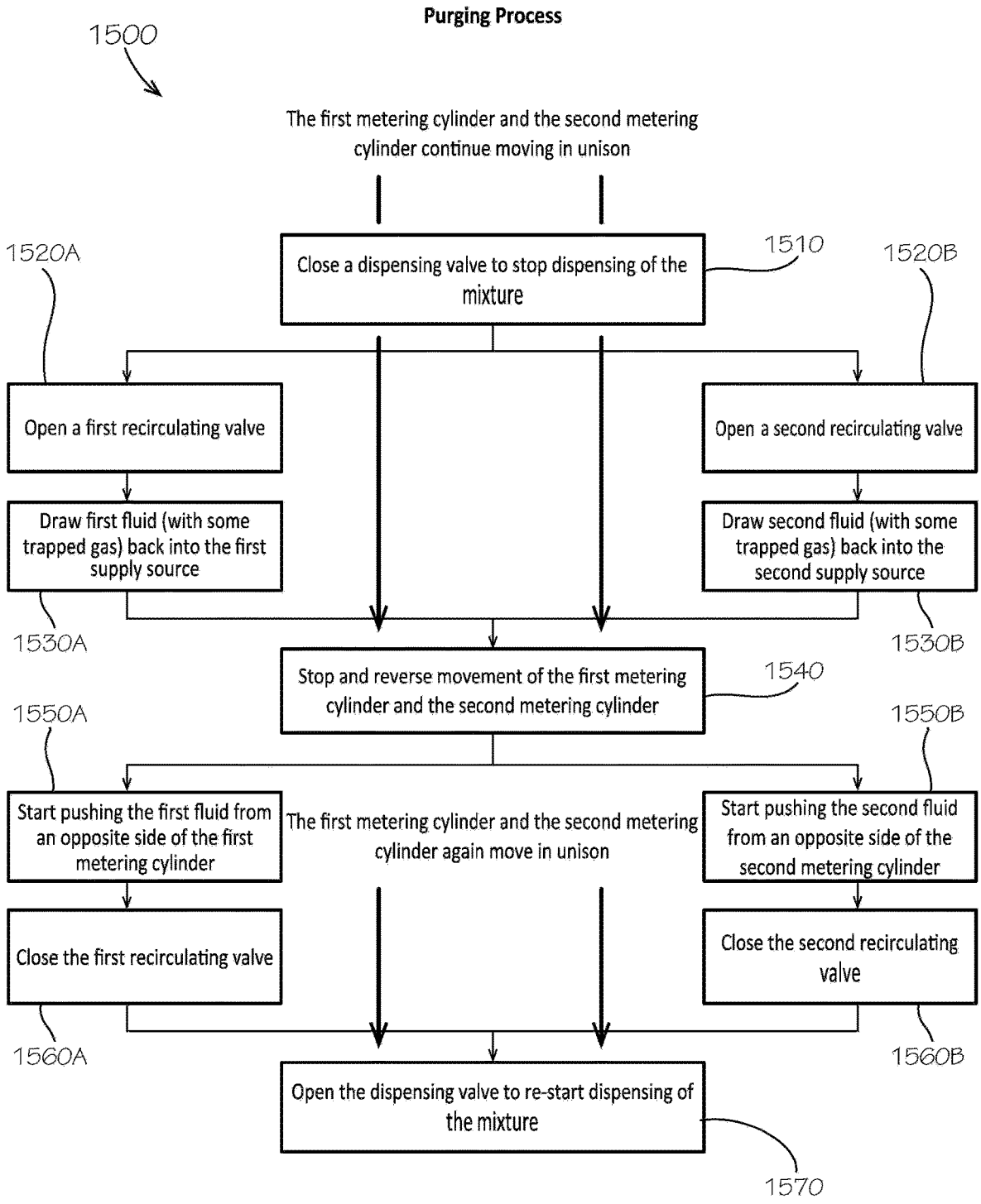
FIG. 15 is a flowchart describing a gas removal or purging process of the system of FIG. 1.

As shown in FIG. 15, the purging process 1500 can comprise any one or more of the following steps. As an initial matter, gas or gas pockets can be introduced into the first material 81 or the second material 82 at any one or more of a number of different steps: before being transferred to the respective supply container 111, 121, in the process of being pumped into the respective preparation tank 114, 124 by the respective transfer pumps 113, 123, in the process of being agitated inside the respective preparation tank 114, 124 by, for example and without limitation, the respective agitators 115, 125, after this point but before being drawn from the respective preparation tank 114, 124, in the process of being pumped into the delivery pipes 117, 127 by the respective delivery pumps 116, 126, in the process of being transferred to the respective metering cylinders 141, 142, and in the process of being transferred from the respective metering cylinders 141, 142. When either of the first material 81 or the second material 82 is a volatile organize compound (VOC), such as, for example and without limitation, polyol, an otherwise liquid material can spontaneously form gas vapors in a process sometimes referred to as outgassing. As with the overall process 1400, the purging process 1500 can comprise moving the first metering cylinder 141 and the second metering cylinder 142 in unison throughout from a first stroke position such as the first stroke position A to a second stroke position such as the second stroke position B, or vice versa.

A step 1510 can comprise closing or locking a dispensing valve of the dispensing head 133 to stop dispensing of each of the first material 81 and the second material 82. Closing the dispensing head 133 can comprise closing or locking out the dispensing head 133 when each of the first metering cylinder 141 and the second metering cylinder 142 is proximate to the second stroke position B. Locking out the dispensing head 133 to stop dispensing of each of the first material 81 and the second material 82 can occur without manual intervention by a user of the system 100. Respective steps 1520A,B can comprise opening a first recycling valve 171, which can be positioned in a fluid line between the first metering cylinder 141 and the dispensing head 133, and opening a second recycling valve 172, which can be positioned in a fluid line between the second metering cylinder and the dispensing head 133. Respective steps 1530A,B can comprise drawing a portion of the first material 81 back into the first supply source and drawing a portion of the second material 82 back into the second supply source. A step 1540 can comprise stopping and reversing movement of the first metering cylinder 141 and the second metering cylinder 142. Respective steps 1550A,B can comprise starting to push the first material 81 from an opposite side of the first metering cylinder 141 and starting to push the second material 82 from an opposite side of the second metering cylinder 142.

In some aspects, the method can comprise keeping each of the first recycling valve 171 and the second recycling valve 172 open until each of the first metering cylinder 141 and the second meter cylinder 142 reaches an end of a programmed stroke interval or programmed stroke distance or until a piston 741, 742 of at least a one of the first metering cylinder 141 and the second metering cylinder 142, respectively, changes direction. The method can further comprise keeping each of the first recycling valve 171 and the second recycling valve 172 open until an end of a pre-programmed interval for clearing the first fluid dispensing connection and the second fluid dispensing connection of trapped gas, where the first fluid dispensing connection fluidly connects the dispensing head 133 with the first metering cylinder 141 and the second fluid dispensing connection fluidly connects the dispensing head 133 with the second metering cylinder 142.

Respective steps 1560A,B can further comprise closing the first recycling valve 171, which can be positioned in the first fluid dispensing connection, and closing the second recycling valve 172, which can be positioned in the second fluid dispensing connection. A step 1570 can comprise opening the dispensing valve of the dispensing head 133 to restart dispensing of each of the mixture 83.

A method of dispensing a single material such as the material 81 can comprise drawing the material 81 from a supply source such as, for example and without limitation, the preparation tank 114, moving the metering cylinder 141 from a first stroke position to a second stroke position, the metering cylinder 141 fluidly connected to the supply source, dispensing the material 81 from the dispensing head 130 fluidly connected to the metering cylinder; automatically closing the dispensing head 130 to stop dispensing of the material based on a position of the metering cylinder 141; and drawing a portion of the material 141 back into the supply source.

A method of manufacturing a dispensing system 100 can comprise: assembling a first fluid delivery connection from a first metering cylinder 141 to a first supply container 111, the first supply container 111 configured to store the first material 81; assembling a second fluid delivery connection from a second metering cylinder 142 to a second supply container 121, the second supply container 121 configured to store the second material 82; assembling a first fluid dispensing connection from the first metering cylinder 141 to the dispensing head 133; assembling a second fluid dispensing connection from the second metering cylinder 142 to the dispensing head 133; assembling the first recycling valve 171 to a portion of the first fluid dispensing connection, the first recycling valve 171 configured to draw a portion of the first material 81 back into the first preparation tank 114 when the first recycling valve 171 is in the open position; and assembling the second recycling valve 172 to a portion of the second fluid dispensing connection, the second recycling valve 172 configured to draw a portion of the second material 82 back into the second preparation tank 124 when the second recycling valve 172 is in the open position.

A method of retrofitting a dispensing system 100 can comprise splicing in the first recycling valve 171 to a portion of the first fluid dispensing connection between the first metering cylinder 141 and the dispensing head 133, the first recycling valve 171 configured to draw a portion of the first material back into the first preparation tank 114 when the first recycling valve 171 is in the open position; and splicing in the second recycling valve 172 to a portion of the second fluid dispensing connection between the second metering cylinder 142 and the dispensing head 133, the second recycling valve configured to draw a portion of the second material back into the second preparation tank 124 when the second recycling valve 172 is in the open position.

A method of using the dispensing system 100 can comprise dispensing the mixture 83 and determining when gas begins to be expelled by the first metering cylinder 141 and the second metering cylinder 142 and optimizing the activation point for the purging process so that it is no earlier than it need be (to avoid unnecessary recirculation of material not containing trapped gas) and no later than it should be (to avoid dispensing of material with trapped gas).

As claimed, a supply container can comprise any of the supply containers 111, 121, the preparation tanks 114, 124, and any other source from which the materials 81, 82 can be drawn.

Figure 16:
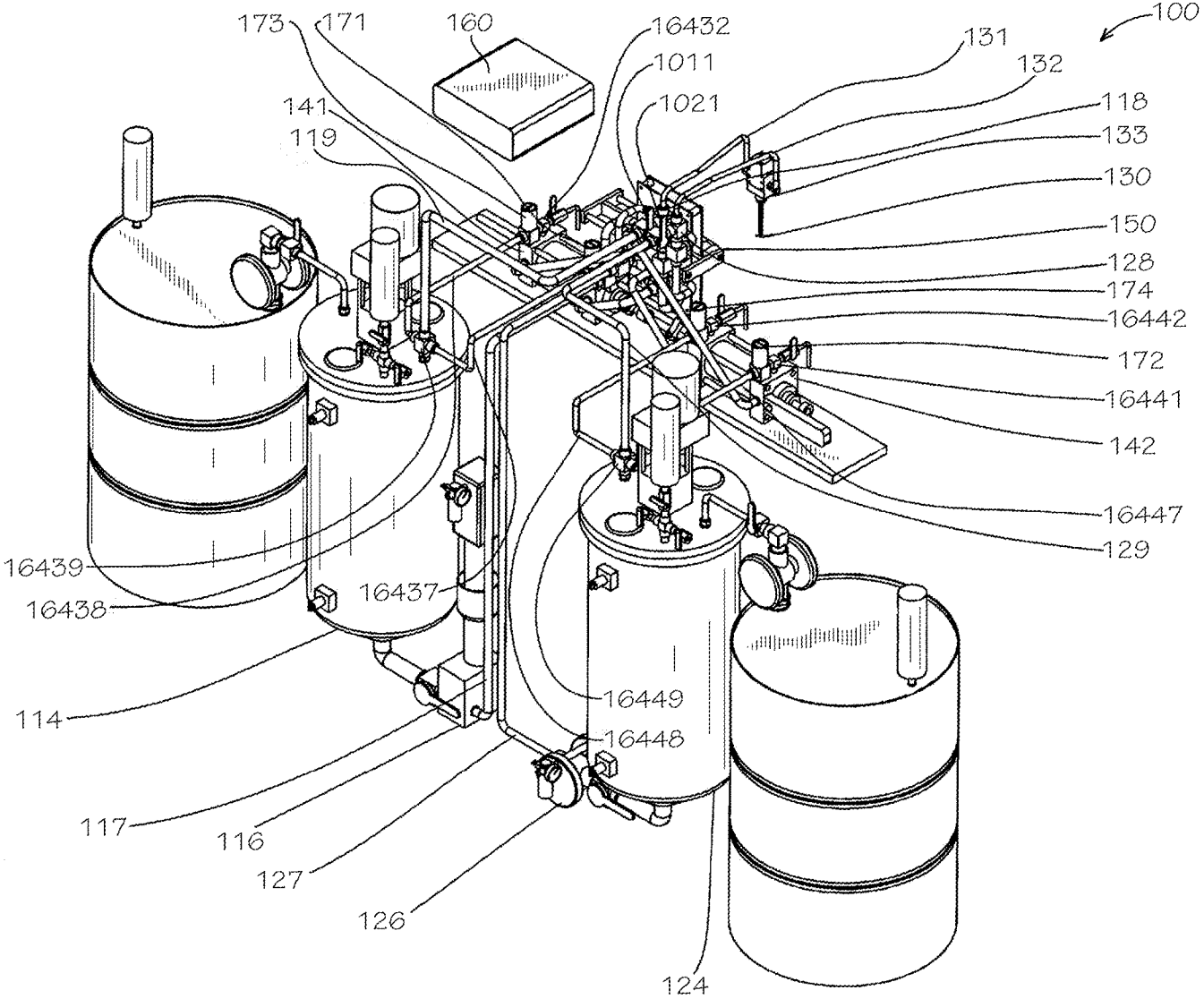
FIG. 16 is a left rear top perspective view of the system of FIG. 1 in a recycling condition in accordance with another aspect of the disclosures, wherein the pair of recycling valves of the system have been replaced with a pair of recycling valves at each metering cylinder.
Figure 17:
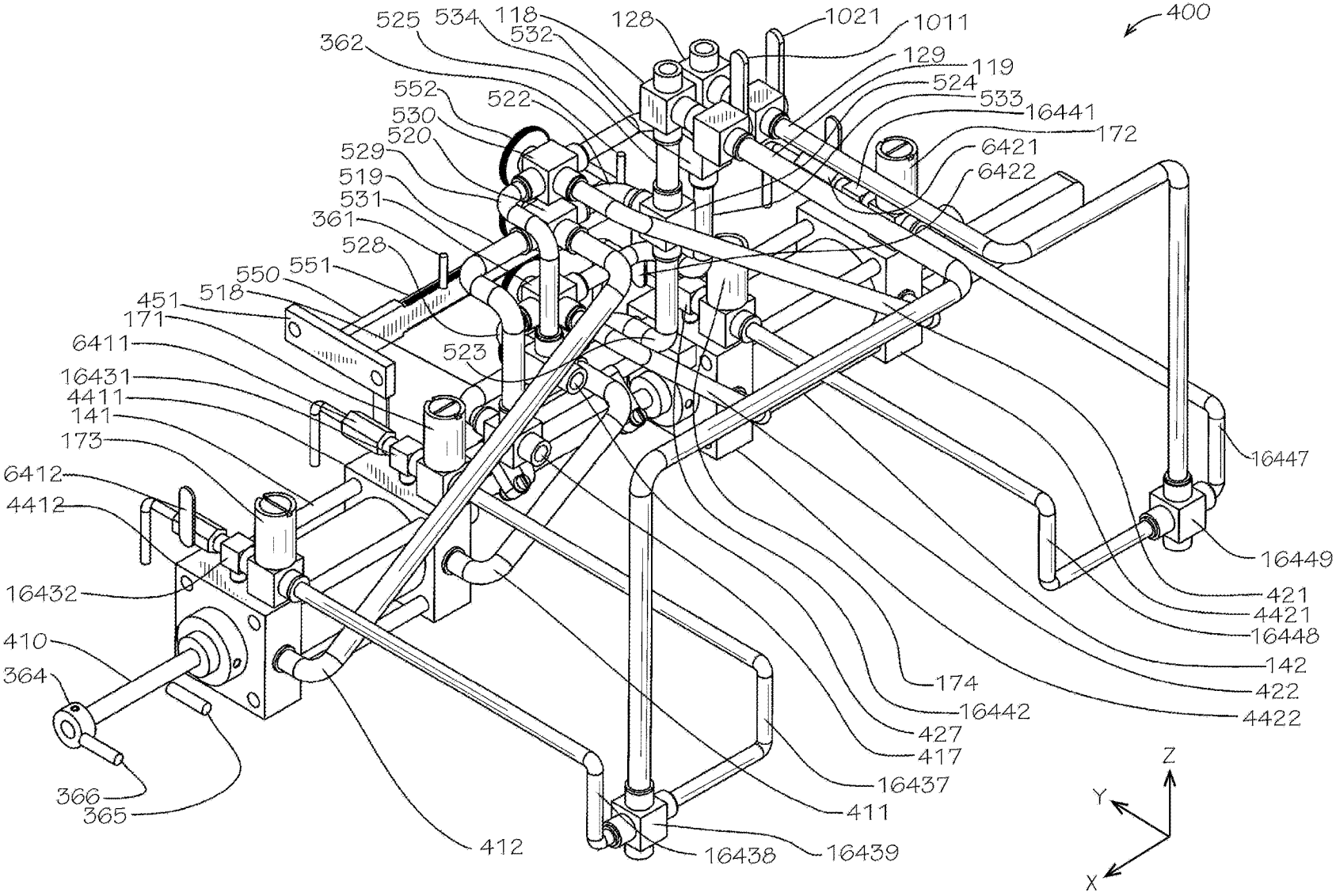
FIG. 17 is a right rear top perspective view of the metering cylinder assembly of the system of FIG. 16 in a recycling condition.

As shown in FIGS. 16 and 17, the system 100 can comprise not only the manual shut-off valves 1011, 1021 but also the recycling valves 171, 172 and recycling valves 173, 174. As shown, each of the recycling valves 171, 172, 173, 174 can be secured directly to one of the metering cylinders 141, 142. For example and without limitation, a pair of the recycling valves 171, 173 can be coupled to and in fluid communication with the first metering cylinder 141. Likewise, a pair of the recycling valves 172, 174 can be coupled to and in fluid communication with the second metering cylinder 142.

More specifically with respect to the first metering cylinder 141, the recycling valve 171 can be coupled to and in fluid communication with a tee fitting 16431 (shown in FIG. 17), which itself can be coupled to and in fluid communication with the first metering cylinder 141 proximate to the first end 4411 (shown in FIG. 17) of the first metering cylinder 141. Similarly, the recycling valve 173 can be coupled to and in fluid communication with a tee fitting 16432, which itself can be coupled to and in fluid communication with the first metering cylinder 141 proximate to the second end 4412 (shown in FIG. 17). More specifically with respect to the second metering cylinder 142, the recycling valve 172 can be coupled to and in fluid communication with a tee fitting 16441, which itself can be coupled to and in fluid communication with the second metering cylinder 142 proximate to the first end 4421 (shown in FIG. 17) of the second metering cylinder 142. Likewise, the recycling valve 173 can be coupled to and in fluid communication with a tee fitting 16442, which itself can be coupled to and in fluid communication with the second metering cylinder 142 proximate to the second end 4422. As shown, either or both of the first bleeder valves 6411, 6421 and the second bleeder valves 6412, 6422 (shown in FIG. 17) can be coupled to and in fluid communication with one of the tee fittings 16431, 16432, 16441, 16442.

Each of the recycling valves 171, 173 can be coupled to and in fluid communication with the first preparation tank 114 via a tee fitting 16439, which can be mounted on or proximate to the first preparation tank 114, and return pipes 16437, 16438 respectively joining the recycling valves 171, 173 to the first preparation tank 114. Likewise, each of the recycling valves 172, 174 can be coupled to and in fluid communication with the second preparation tank 124 via a tee fitting 16449, which can be mounted on or proximate to the second preparation tank 124, and return pipes 16447, 16448 respectively joining the recycling valves 172, 174 to the second preparation tank 124.

Placing the separate recycling valves 171, 172, 173, 174 more directly in fluid communication with the respective gas exit cavities 7411, 7421, 7412, 7422 by mounting the recycling valves 171, 172, 173, 174 to the ends 4411, 4421, 4412, 4422 of the corresponding metering cylinders 141, 142 can facilitate more efficient and effective removal and transfer of entrapped gas (such as, for example and without limitation, the trapped gas found in the material 81) from the system to the preparation tanks 114, 124 without introduction of the entrapped gas into the mixture 83. More specifically, placing the recycling valves 171, 172, 173, 174 nearer to the entrapped gas inside the metering cylinders 141, 142 can facilitate greater separation of the entrapped gas from the liquid portion of the respective material 81, 82 by reducing the distance across which the material 81, 82 with entrapped gas needs to be pushed to remove it from the metering cylinders 141, 142 and return it to the preparation tanks, thereby reducing pressure losses inside the affected piping and valves of the system and any resistance to flow resulting therefrom.

In some aspects, the material 81 can be discharged through the respective gas exit cavities 7411, 7421, 7412, 7422 and the lighter portion 7433 (shown in FIG. 13) sent back to the preparation tank 114 for recycling. More specifically, as the piston 741 (shown in FIG. 13) pushes the liquid portion of the first material 81 out of the first metering cylinder 141 through the second transfer port 5412, at a desired stroke position the appropriate recycling valves 171, 172, 173, 174 can be opened and the dispensing head 133 closed to allow continued movement of the piston 741 to push the material 81 and any entrapped gas back into a supply source such as, for example and without limitation, the preparation tank 114 for recycling. The material 82 and any entrapped gas can be similarly recycled.

In some aspects, the target mixture 83 can be a 1.59:1 ratio mixture of the materials 81, 82. Furthermore, it can in some cases be acceptable for the first material 81 to be greater in volume or less in volume than the volume of the second material by only 2.5% (i.e., a more sensitive mixture ratio can be accommodated by the system 100 with the four recycling valves 171, 172, 173, 174).

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method of dispensing a mixture of two fluids, the method comprising:

drawing a first fluid from a first supply source, the first fluid comprising a first liquid;

drawing a second fluid from a second supply source, the second fluid comprising a second liquid;

moving a first metering cylinder and a second metering cylinder in unison from a first stroke position to a second stroke position, the first metering cylinder fluidly connected to the first supply source and the second metering cylinder fluidly connected to the second supply source;

simultaneously dispensing each of the first fluid and the second fluid from a dispensing head fluidly connected to the first metering cylinder with a first fluid dispensing connection and to the second metering cylinder with a second fluid dispensing connection;

automatically closing the dispensing head with a controller to stop dispensing of each of the first fluid and the second fluid based on a position of a piston of each of the first metering cylinder and the second metering cylinder;

drawing a portion of the first fluid back into the first supply source, wherein drawing the portion of the first fluid back into the first supply source comprises opening a first recycling valve with the controller, the first recycling valve fluidly connected to the system at a position between the first metering cylinder and the dispensing head; and drawing a portion of the second fluid back into the second supply source, wherein drawing the portion of the second fluid back into the second supply source comprises opening a second recycling valve with the controller, the second recycling valve fluidly connected to the system at a position between the second metering cylinder and the dispensing head.

2. The method of claim 1, further comprising:

pumping the first fluid from the first supply source to the first metering cylinder with a first pump; and pumping the second fluid from the second supply source to the second metering cylinder with a second pump, a cycle timing of the first pump not synchronized with a cycle timing of the second pump.

3. The method of claim 1, wherein the first fluid is a hardener and the second fluid is a resin, a viscosity of the first liquid being substantially different than a viscosity of the second liquid, the dispensing head comprising a dispensing nozzle, wherein simultaneously dispensing each of the first fluid and the second fluid from the dispensing head comprises dispensing a polyurethane epoxy material from the dispensing nozzle.

4. The method of claim 1, wherein closing the dispensing head to stop dispensing of each of the first fluid and the second fluid comprises locking out the dispensing head when each of the first metering cylinder and the second metering cylinder is proximate to the second stroke position.

5. The method of claim 1, wherein locking out the dispensing head to stop dispensing of each of the first fluid and the second fluid occurs without manual intervention by a user of a system.

6. The method of claim 1, further comprising keeping each of the first recycling valve and the second recycling valve open until:

each of the first metering cylinder and the second meter cylinder reaches an end of a programmed stroke distance; and an end of a programmed interval of time for clearing the first fluid dispensing connection and the second fluid dispensing connection of trapped gas.

7. The method of claim 1, further comprising opening the dispensing head to restart dispensing of the mixture.

8. The method of claim 7, further comprising:

closing a first recycling valve positioned proximate to a first end of the first metering cylinder; and closing a second recycling valve positioned proximate to a first end of the second metering cylinder.

9. The method of claim 1, wherein each of the first recycling valve and the second recycling valve is one of an electronic valve and a pneumatic valve.

10. The method of claim 9, wherein each of the first recycling valve and the second recycling valve is an electronic valve.

* * * * *